US009909376B2

(12) United States Patent
Hrametz et al.

(10) Patent No.: US 9,909,376 B2
(45) Date of Patent: Mar. 6, 2018

(54) LATCHING ASSEMBLY FOR WELLBORE LOGGING TOOLS AND METHOD OF USE

(71) Applicant: Halliburton Energy Services, Inc., Houston, TX (US)

(72) Inventors: Andrew Albert Hrametz, Rosenberg, TX (US); Nathan James Harder, Spring, TX (US); Arabinda Misra, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 634 days.

(21) Appl. No.: 14/378,876

(22) PCT Filed: Dec. 28, 2012

(86) PCT No.: PCT/US2012/071986

§ 371 (c)(1),
(2) Date: Aug. 14, 2014

(87) PCT Pub. No.: WO2013/133890

PCT Pub. Date: Sep. 12, 2013

(65) Prior Publication Data

US 2015/0042487 A1 Feb. 12, 2015

Related U.S. Application Data

(63) Continuation of application No. 14/240,522, filed as application No. PCT/US2012/044540 on Jun. 28, 2012, now Pat. No. 8,875,808.

(Continued)

(51) Int. Cl.

*E21B 23/02* (2006.01)
*E21B 47/01* (2012.01)

(Continued)

(52) U.S. Cl.

CPC ..... *E21B 23/02* (2013.01); *E21B 17/06* (2013.01); *E21B 23/01* (2013.01); *E21B 23/08* (2013.01);

(Continued)

(58) Field of Classification Search

CPC ..... E21B 47/01; E21B 47/12; E21B 47/16; E21B 23/01; E21B 23/02; E21B 17/06; E21B 23/08; E21B 23/14; E21B 47/06

See application file for complete search history.

(56) References Cited

U.S. PATENT DOCUMENTS 2,950,538 A * 8/1960 Brandon ..... E21B 47/08 200/16 B
3,378,069 A 4/1968 Fields (Continued)

FOREIGN PATENT DOCUMENTS

FR 2910048 6/2008
FR 2910049 6/2008

(Continued)

OTHER PUBLICATIONS

Canadian Office Action, Canadian Application No. 2,866,289, dated Nov. 24, 2015, 5 pages.

(Continued)

*Primary Examiner* — Nicole Coy
(74) *Attorney, Agent, or Firm* — Scott Richardson; Parker Justiss, P.C.

(57) ABSTRACT

A latching assembly for wellbore logging tools includes a bottom hole assembly to be disposed on a distal end of a drill string. The bottom hole assembly includes a landing sub having a bore with a latching mechanism that includes latch jaws and bias springs. The latch jaws can receive a landing shoulder. The biasing spring has a closing arm and an opening arm to respectively close and open the latch jaws.

(Continued)

The bottom hole assembly includes a tool string that includes the landing shoulder for engaging with the latch jaw of the landing sub, the biasing spring, and a logging assembly that includes at least one logging tool for obtaining and storing data about at least one geologic formation penetrated by the wellbore.

35 Claims, 18 Drawing Sheets

Related U.S. Application Data

(60) Provisional application No. 61/608,970, filed on Mar. 9, 2012.

(51) Int. Cl.

| | |
|---|---|
| ***E21B 23/14*** | (2006.01) |
| ***E21B 17/06*** | (2006.01) |
| ***E21B 47/12*** | (2012.01) |
| ***E21B 47/16*** | (2006.01) |
| ***E21B 23/08*** | (2006.01) |
| ***E21B 23/01*** | (2006.01) |
| ***E21B 47/06*** | (2012.01) |

(52) U.S. Cl.

CPC ..... *E21B 23/14* (2013.01); *E21B 47/01* (2013.01); *E21B 47/06* (2013.01); *E21B 47/12* (2013.01); *E21B 47/122* (2013.01); *E21B 47/124* (2013.01); *E21B 47/16* (2013.01)

(56) References Cited

U.S. PATENT DOCUMENTS

| | | | |
|---|---|---|---|
| 4,041,780 | A | 8/1977 | Angehrn |
| 4,349,072 | A | 9/1982 | Escaron et al. |
| 4,485,870 | A | 12/1984 | Walulik |
| 4,597,440 | A | 7/1986 | Pottier |
| 4,664,189 | A | 5/1987 | Wittrisch |
| 4,715,446 | A | 12/1987 | Wittrisch |
| 4,729,429 | A | 3/1988 | Wittrisch |
| 4,783,995 | A | 11/1988 | Michel et al. |
| 4,790,380 | A | 12/1988 | Ireland et al. |
| 4,807,717 | A | 2/1989 | Winters et al. |
| 5,111,880 | A | 5/1992 | Wittrisch et al. |
| 5,217,075 | A | 6/1993 | Wittrisch |
| 5,566,757 | A | 10/1996 | Carpenter et al. |
| 5,589,825 | A | 12/1996 | Pomerleau |
| 6,119,777 | A | 9/2000 | Runia |
| 6,419,013 | B1 | 7/2002 | Milne et al. |
| 6,488,085 | B1 | 12/2002 | Milne et al. |
| 6,578,631 | B2 | 6/2003 | Milne et al. |
| 6,755,257 | B2 | 6/2004 | Spencer et al. |
| 6,843,317 | B2 | 1/2005 | Mackenzie |
| 7,188,672 | B2 | 3/2007 | Berkheimer et al. |
| 7,201,231 | B2 | 4/2007 | Chaplin et al. |
| 7,363,967 | B2 | 4/2008 | Burris, II et al. |
| 7,537,061 | B2 | 5/2009 | Hall et al. |
| 7,661,475 | B2 | 2/2010 | Sheiretov et al. |
| 7,905,282 | B2 | 3/2011 | Bissonnette et al. |
| 8,022,838 | B2 | 9/2011 | Murphy |
| 8,561,697 | B2 | 10/2013 | Strickland |
| 8,689,867 | B2 | 4/2014 | MacDougall et al. |
| 9,116,016 | B2 * | 8/2015 | Shampine ..... G01D 5/145 |
| 2002/0057210 | A1 | 5/2002 | Frey et al. |
| 2002/0117300 | A1 | 8/2002 | Spencer et al. |
| 2003/0056984 | A1 | 3/2003 | Smith et al. |
| 2003/0058125 | A1 | 3/2003 | Ciglenec et al. |
| 2004/0069488 | A1 | 4/2004 | Chaplin et al. |
| 2004/0245020 | A1 | 12/2004 | Giroux et al. |
| 2005/0167098 | A1 | 8/2005 | Lovell et al. |
| 2006/0054354 | A1 | 3/2006 | Orban |
| 2006/0118298 | A1 | 6/2006 | Millar et al. |
| 2006/0220651 | A1 | 10/2006 | Clark |
| 2007/0119626 | A9 | 5/2007 | Giroux et al. |
| 2007/0284116 | A1 | 12/2007 | Hall et al. |
| 2008/0093124 | A1 | 4/2008 | Giroux et al. |
| 2008/0110673 | A1 | 5/2008 | Giroux et al. |
| 2008/0202767 | A1 | 8/2008 | Sheiretov et al. |
| 2008/0236841 | A1 | 10/2008 | Howlett et al. |
| 2009/0014175 | A1 | 1/2009 | Peter |
| 2009/0045975 | A1 | 2/2009 | Evans et al. |
| 2009/0194271 | A1 | 8/2009 | Bissonnette et al. |
| 2009/0299654 | A1 | 12/2009 | Garvey et al. |
| 2010/0089567 | A1 | 4/2010 | Constantinou et al. |
| 2010/0132955 | A1 | 6/2010 | Storm, Jr. et al. |
| 2011/0083845 | A1 | 4/2011 | McLaughlin |
| 2011/0308797 | A1 | 12/2011 | Umphries et al. |

FOREIGN PATENT DOCUMENTS

| | | |
|---|---|---|
| GB | 2344123 | 5/2000 |
| WO | WO 19961001359 | 1/1996 |
| WO | WO 20001017488 | 3/2000 |
| WO | WO 2000/060212 | 10/2000 |
| WO | WO 20021073003 | 9/2002 |
| WO | WO 20101089525 | 8/2010 |
| WO | WO 2013/133860 | 9/2013 |
| WO | WO 2013/133861 | 9/2013 |
| WO | WO 2013/133890 | 9/2013 |

OTHER PUBLICATIONS

Patent Examination Report No. 1, Australian Application No. 2012372832, dated Jul. 21, 2015, 2 pages.

Authorized Officer Athina Nickitas-Etienne, PCT International Preliminary Report on Patentability, PCT/US2012/044540, dated Sep. 18, 2014, 8 pages.

Patent Examination Report No. 1, Australian Application No. 2012372787, dated Sep. 25, 2015, 3 pages.

Authorized Officer Philippe Becamel, PCT International Preliminary Report on Patentability, PCT/US2012/071986, dated Sep. 18, 2014, 10 pages.

International Search Report and Written Opinion of the International Searching Authority issued in International Application No. PCT/US2013/037413 dated Jan. 20, 2014; 16 pages.

International Search Report and Written Opinion of the International Searching Authority issued in International Application No. PCT/US2012/071986 dated Jan. 8, 2014; 15 pages.

International Search Report and Written Opinion of the International Searching Authority issued in International Application No. PCT/US2012/044540 dated Nov. 11, 2013; 11 pages.

International Search Report and Written Opinion of the International Searching Authority issued in International Application No. PCT/US2012/044544 dated Nov. 11, 2013; 12 pages.

International Search Report and Written Opinion of the International Searching Authority issued in International Application No. PCT/US2012/071624 dated Oct. 9, 2013; 11 pages.

Runia et al., "Through Bit Logging: A New Method to Acquire Log Data, and a First Step on the Road to Through Bore Drilling" SPWLA 45th Annual Logging Symposium, Jun. 6-9, 2004, 8 pages.

Runia et al., "Through Bit Logging: Applications in Difficult Wells, Offshore North Sea" SPE/IADC 92256, Feb. 23-25, 2005, 8 pages.

Invitation to Pay Additional Fees and Partial International Search Report issued in International Application No. PCT/US2012/071986 dated Nov. 15, 2013; 4 pages.

International Search Report and Written Opinion of the International Searching Authority issued in International Application No. PCT/US2014/014606 dated May 19, 2014; 15 pages.

* cited by examiner 200
210
211
202
213
220
216
215

217
218

221
222

231
233

A

B

243

251
253
220

LATCHING ASSEMBLY FOR WELLBORE LOGGING TOOLS AND METHOD OF USE

CLAIM OF PRIORITY

This application is a 371 U.S. National Stage of International Application No. PCT/US2012/071986, filed Dec. 28, 2012, which claims priority to U.S. Provisional Application No. 61/608,970, filed Mar. 9, 2012. This application is also a Continuation of U.S. patent application Ser. No. 14/240,522, filed Feb. 24, 2014, which is a 371 U.S. National Stage of International Application No. PCT/US2012/044540, filed Jun. 28, 2012, which claims priority to U.S. Provisional Application No. 61/608,970, filed Mar. 9, 2012.

This disclosure relates to devices, methods and assemblies for conveying, landing and latching logging tools in a wellbore.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of such diagnostic well logs include Neutron logs, Gamma Ray logs, Resistivity logs and Acoustic logs. Logging tools frequently are used for log data acquisition in a wellbore by logging in an upward (up hole) direction, from a bottom portion of the wellbore to an upper portion of the well bore. The logging tools, therefore, need first be conveyed to the bottom portion of the wellbore. In many instances, wellbores can be highly deviated, or can include a substantially horizontal section. Such wellbores make downward movement of the logging tools in the wellbore difficult, as gravitational force becomes insufficient to convey the logging tools downhole.

SUMMARY

The present disclosure relates to devices, methods and assemblies for conveying, landing and latching logging tools in a wellbore.

In a general aspect, the well bore logging tool assembly of the present disclosure includes a bottom hole assembly to be disposed on a distal end of a drill string. The bottom hole assembly includes a landing sub having a bore with a latching mechanism disposed therein. The latching mechanism includes latch jaws and bias springs. The latch jaws can receive a landing shoulder. The biasing spring has a closing arm and an opening arm to respectively close and open the latch jaws. The bottom hole assembly includes a tool string that includes the landing shoulder for engaging with the latch jaw of the landing sub, the biasing spring, and a logging assembly that includes at least one logging tool operable to obtain and store data about at least one geologic formation penetrated by the wellbore.

The general aspect may further include one or more of the following features either individually or in combination. The wellbore logging tool assembly can further include a diagnostic module operable to run a diagnostic sequence to determine if the at least one logging tool is functioning properly and to send a signal to the release assembly. A sensing device can be adapted to detect when the logging assembly is landed in the landing sub and send a signal to the diagnostic module. The signal sent by the sensing device can include notification of the diagnostic module that the logging assembly is in proper position for logging and that the diagnostic module may begin the diagnostic sequence on the at least one logging tool.

More features can be included individually or in combination with the latch assembly. For example, the latch assembly can further include a landing sleeve disposed in the bore of the landing sub wherein at least one magnet is disposed in the landing sleeve. The sensing device disposed in the tool string can include a switch adapted to close when the switch (e.g., a reed switch) in the tool string is proximal to the magnet in the landing sleeve. The bottom hole assembly can further include a deployment sub disposed on a distal end of the bottom hole assembly. The deployment sub can have a longitudinal bore therethrough. The deployment sub can be adapted to support the logging tool when the logging assembly is landing in the landing sub and the logging tool extends through the bore. The logging tool is configured to extend below the distal end of the bottom hole assembly when the logging tool assembly is landed in the landing sub. The logging assembly can further include a memory module operable to store data obtained by the logging tool, and a battery disposed in the tool string for supplying power to the memory module.

The details of one or more embodiments are set forth in the accompanying drawings and the description below.

DETAILED DESCRIPTION

Figure 1A:
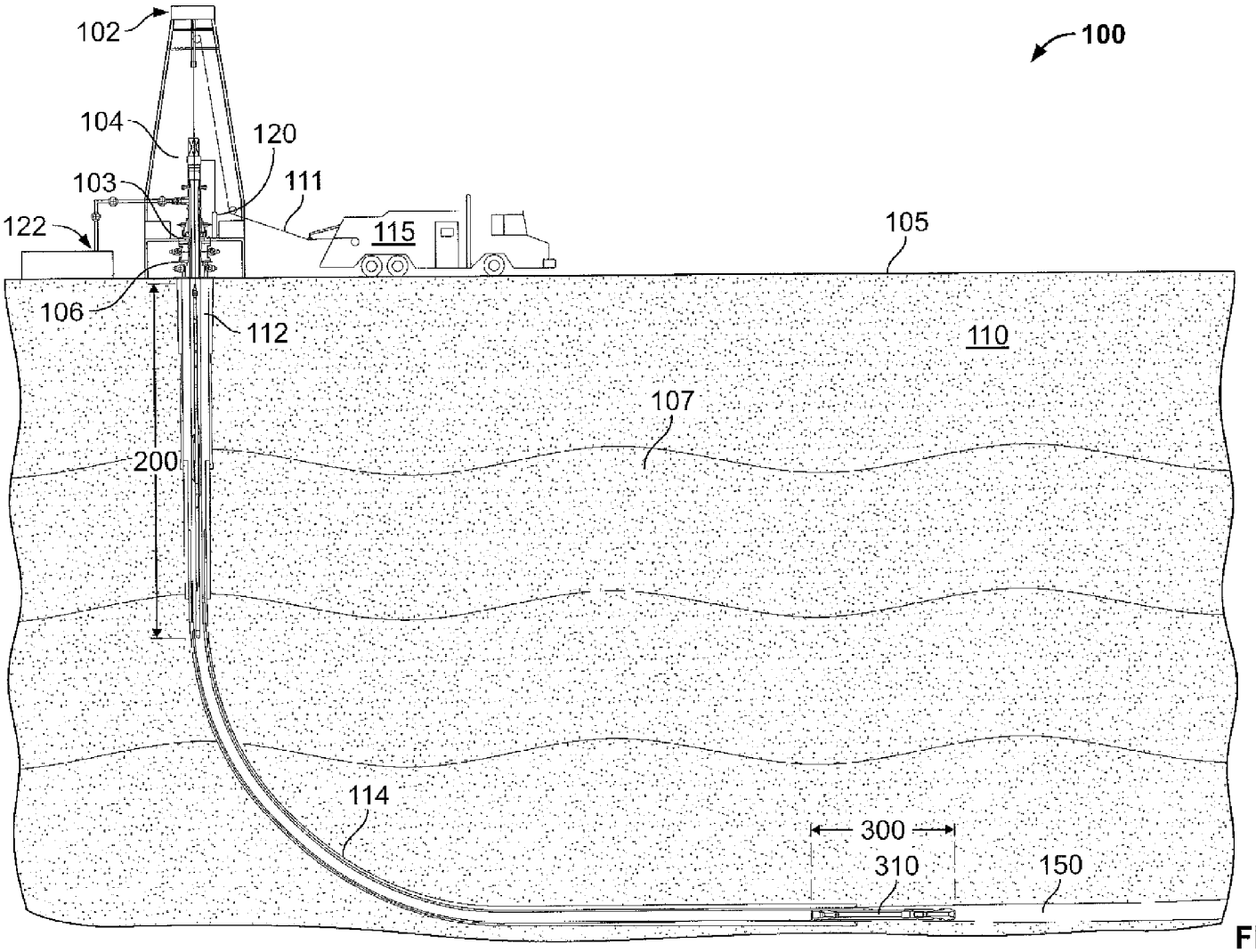
FIGS. 1A to 1E illustrate operations of a logging tool conveying system.

The present disclosure relates to systems, assemblies, and methods for conveying and landing logging tools in a well where adverse conditions may be present to challenge downward movement of the logging tools in the wellbore. The disclosed logging tool conveying systems, assemblies, and methods can reduce risk of damage to the logging tools and increase speed and reliability of moving the logging tools into and out of wellbores. For example, certain wells can be drilled in a deviated manner or with a substantially horizontal section. In some conditions, the wells may be drilled through geologic formations that are subject to swelling or caving, or may have fluid pressures that make passage of the logging tools unsuitable for common conveyance techniques. The resistance during conveying logging tools in the formation may require high actuation pressure that has potential in damaging the logging tools at landing. The present disclosure overcomes these difficulties and provides several technical advances. For example, a latch mechanism engaging with logging tools and absorbing impact energy is used in a landing sub to reduce potential damage during landing. In particular, the logging tools can include a latch mechanism dampening and arresting the logging tool string in a landing sub disposed in the drill string located in the wellbore, a magnetic switch for sensing the position of the logging tool string in the landing sub of the drill string and signaling the logging tools to power up for obtaining data and other functionally enhancing components such as additional battery sections for extended recording time, or low power consumption tools. The latch mechanism utilizes movable latching jaws to catch the logging tool and an integrated axial shock-dampened spring to absorb impact energy during landing. A specialized bias spring is used to keep the movable latching jaws at open position before engaging with the logging tools and close the movable latching jaws to engaging position to arrest the logging tools as well as to dampen the movement using friction when the logging tools are landing.

In addition, in the present disclosure surface pressure is measured using conventional surface pressure measuring equipment connected to the surface pump system such as gauges and recorders and a surface pressure signature is created for indicating when the logging tools have been positioned downhole and are ready to begin data acquisition in the wellbore, and when other associated functions such as releasing the logging tools, retrieving the running tool or retrieving the logging tool can be initiated. The logging tools can be conveyed with an electric wireline cable (sometimes referred to in the art as an "E-line"), or a generally smooth wire cable (sometimes referred to in the art as a "Slickline"), without communication by the logging tools to a data well log data processing unit located at the surface (sometimes referred to in the art as a "logging unit" or "logging truck").

FIGS. 1A to 1E illustrate operations of a logging tool conveying system 100. The logging tool conveying system 100 includes surface equipment above the ground surface 105 and a well and its related equipment and instruments below the ground surface 105. In general, surface equipment provides power, material, and structural support for the operation of the logging tool conveying system 100. In the embodiment illustrated in FIG. 1A, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged such as a logging tool lubrication assembly 104 and a pack off pump 120. In some implementations a blowout preventer 103 will be attached to a casing head 106 that is attached to an upper end of a well casing 112. The rig pump 122 provides pressurized drilling fluid to the rig and some of its associated equipment. The data logging and control truck 115 monitors the data logging operation and receives and stores logging data from the logging tools. Below the rig 102 is a wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1A. Near the surface 105, part of the wellbore 150 may be reinforced with the casing 112. A drill pipe string 114 can be lowered into the wellbore 150 by progressively adding lengths of drill pipe connected together with tool joints and extending from the rig 102 to a predetermined position in the wellbore 150. A bottom hole assembly 300 may be attached to the lower end of the drill string with any suitable attachment structure such as, for example, a threaded connection, before lowering the drill string 114 into the well bore.

At a starting position as shown in FIG. 1A, a logging tool string 200 is inserted inside the drill pipe string 114 near the upper end of the longitudinal bore of the drill pipe string 114 near the surface 105. The logging tool string 200 may be attached with a cable 111 via a crossover tool 211. As noted above, the bottom hole assembly 300 is disposed at the lower end of the drill string 114 that has been previously lowered into the wellbore 150. The bottom hole assembly 300 may include a landing sub 310 that can engage with the logging tool string 200 once the logging tool string 200 is conveyed to the bottom hole assembly 300. The conveying process is conducted by pumping a fluid from the rig pump 122 into the upper proximal end of the drill string 114 bore above the logging tool string 200 to assist, via fluid pressure on the logging tool string 200, movement of the tool string 200 down the bore of the drill string 114. The fluid pressure above the logging tool string 200 is monitored constantly, for example, by the data logging control truck, because the fluid pressure can change during the conveying process and exhibit patterns indicating events such as landing the tool string 200 at the bottom hole assembly 300. As the tool string 200 is pumped (propelled) downwards by the fluid pressure that is pushing behind the tool string 200 down the longitudinal bore of the drill pipe string 114, the cable 111 is spooled out at the surface. It will be understood that, in some implementations, the tool string 200 may be inserted proximal to the upper end of the drill pipe string 114 near the surface 105 without being connected to the cable 111 (e.g., a wireline, E-line or Slickline); and the tool string 200 can be directly pumped down (e.g., without tension support from the surface 105) the drill pipe string 114 and landed in the bottom hole assembly 300 as described herein.

Figure 1B:
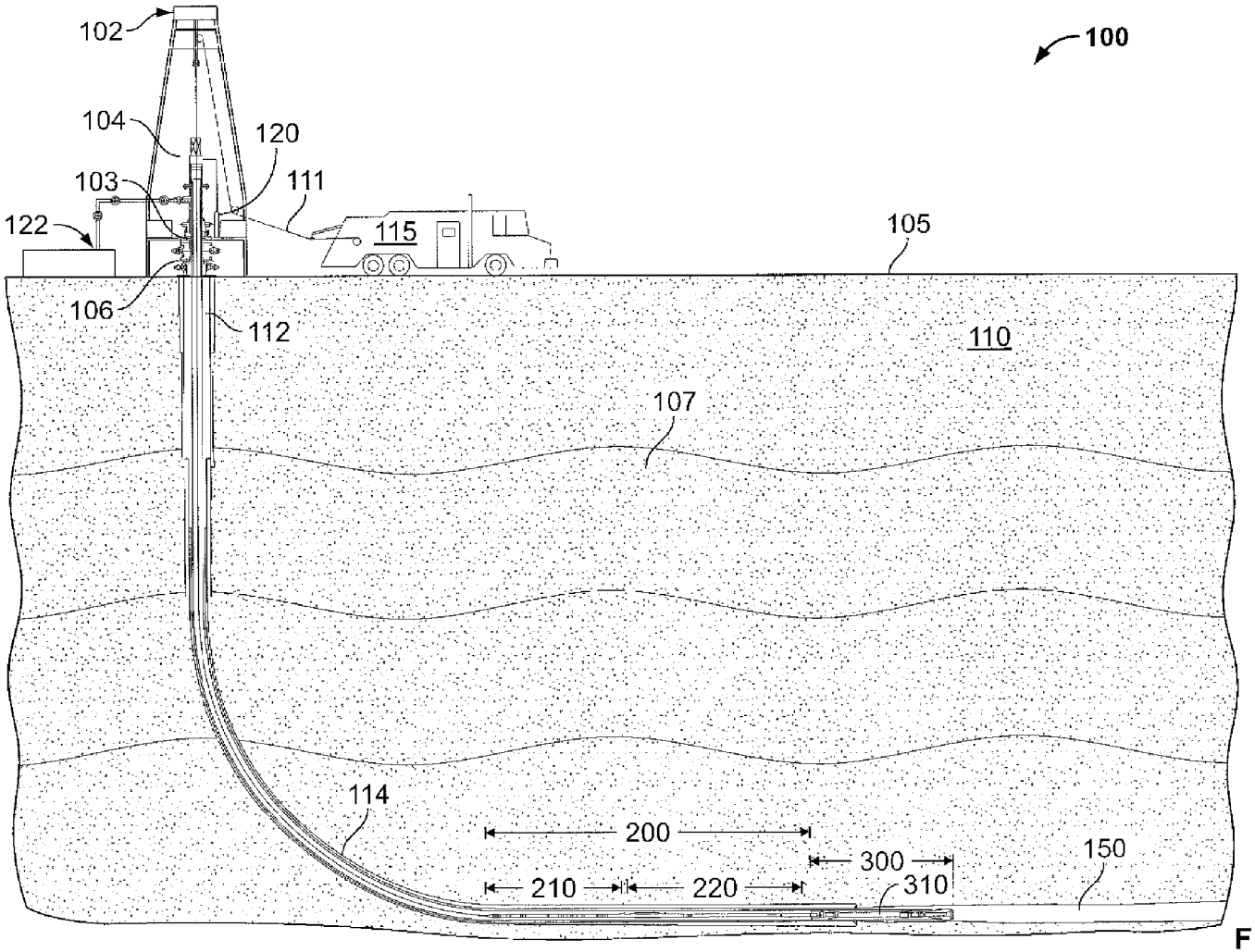
Figure 1C:
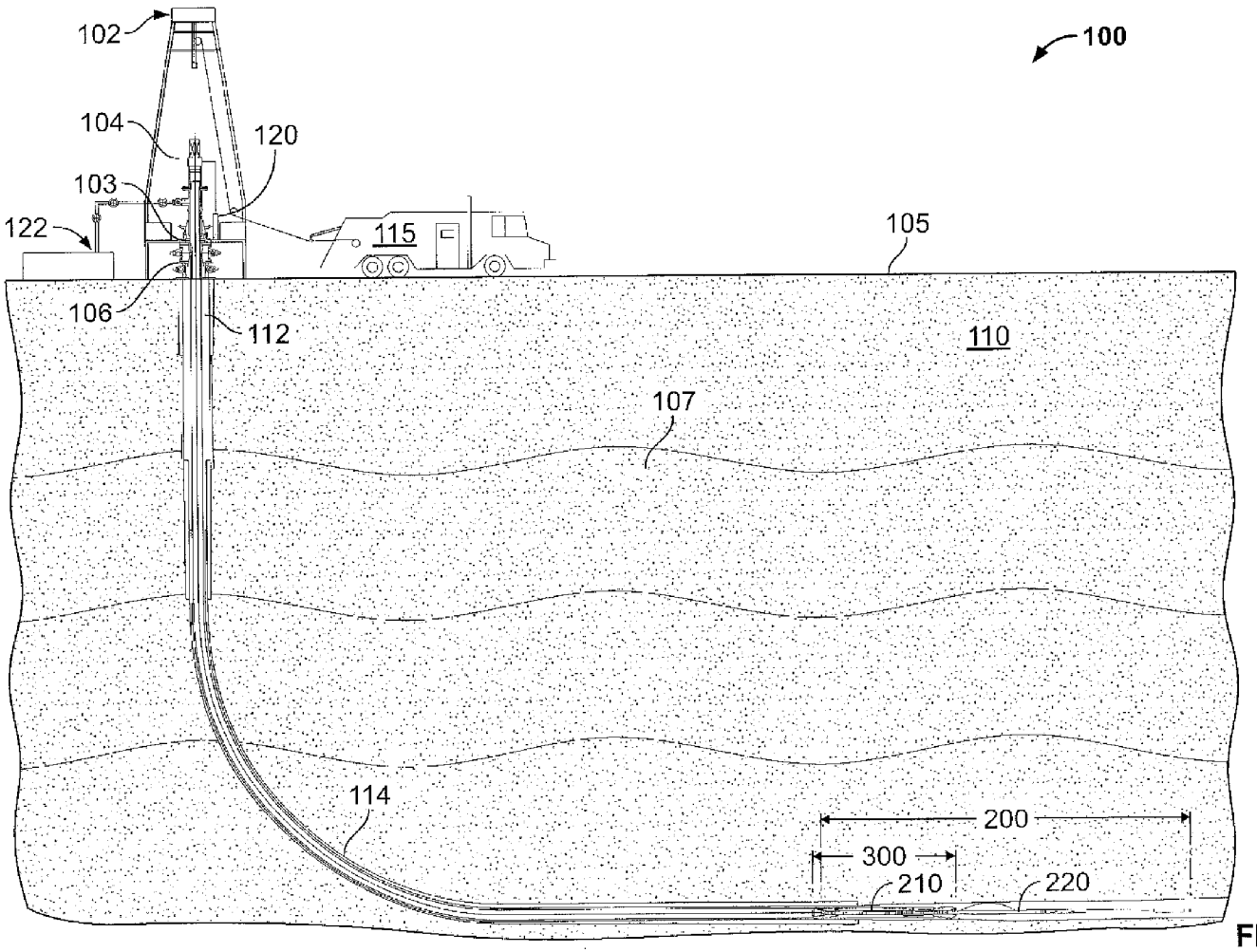

In FIG. 1B, the logging tool string 200 is approaching the bottom hole assembly 300. The tool string 200 is to be landed in the landing sub 310 disposed in the bottom hole assembly 300 which is connected to the distal lower portion of the drill pipe string 114. At least a portion of the tool string 200 has logging tools that, when the tool string is landed in the bottom hole assembly 300, will be disposed below the distal end of the bottom hole assembly of the drill pipe string 114. In some implementations, the logging tool string 200 includes two portions: a landing assembly 210 and a logging tool assembly 220. As illustrated in FIG. 1B, the landing assembly 210 is to be engaged with the bottom hole assembly 300 and the logging tool assembly 220 is to be passed through the bottom hole assembly 300 and disposed below the bottom hole assembly. This enables the logging tools to have direct access to the geologic formations from which log data is to be gathered. Details about the landing assembly 210 and the logging tool assembly 220 are described in FIGS. 2A to 2E. As the tool string 200 approaches the bottom hole assembly 300, the rig pump 122 fluid pressure is observed at the surface 105; for example, at the data logging control truck 115.

Figure 1D:
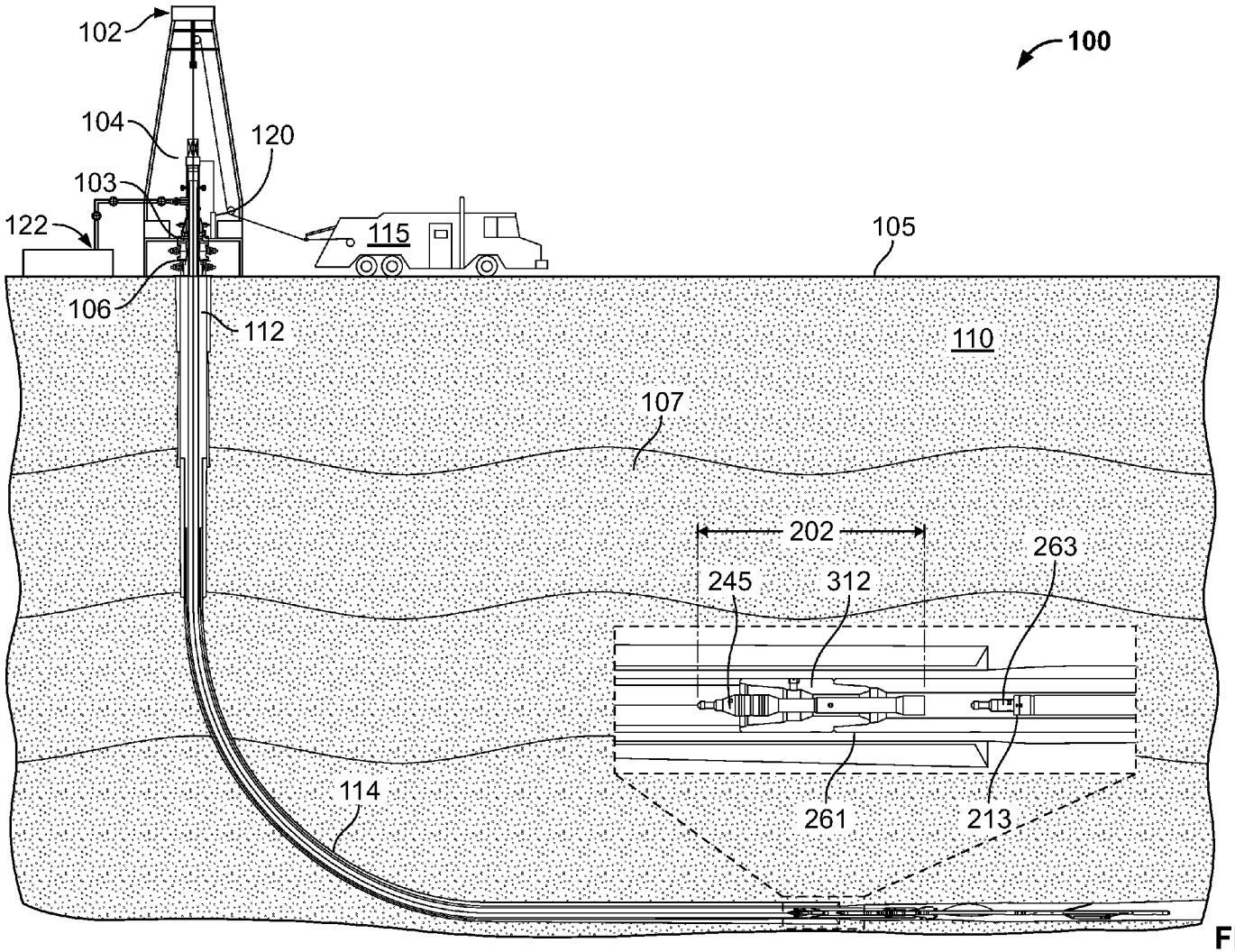

A sudden increase of the fluid pressure can indicate that the tool string 200 has landed in the landing sub 310 of the bottom hole assembly 300. For example, in FIG. 1C, the logging tool string 200 has landed and engaged with landing sub 310 of the bottom hole assembly 300. The fluid pressure increases because the fluid is not able to circulate past the outside of the upper nozzle 245 when it is seated in the nozzle sub 312. A self-activating diagnostic sequence can be automatically initiated by a diagnostic module located in the logging tool assembly 220 to determine if the logging tool assembly 220 is properly functioning. Referring to FIG. 1D, when the proper functioning of the logging tool assembly 220 is confirmed by the downhole diagnostics module, instructions are sent from the downhole diagnostics module to the downhole motor release assembly 213 to release the running tool assembly 202 from the logging tool assembly 220 and displace the running tool 202 away from the upper end of the tool string 200. The running tool 202 includes a crossover tool 211 that connects the cable 111 to the upper nozzle 245 and the spring release assembly 261. A decrease in the pump pressure can then be observed as indicative of release and displacement of the running tool 202 from the tool string 200 which again allows fluid to freely circulate past upper nozzle 245. Once the pressure decrease has been observed at the surface, the cable 111 is spooled in by the logging truck 115. The motor release assembly 213 can include a motorized engagement mechanism that activates spring release dogs (not shown) that are securing the running tool 202 to the fishing neck 263. The spring release assembly 261 can include a preloaded spring (not shown) which forcibly displaces the running tool 202 from the landing nozzle 312.

Figure 1E:
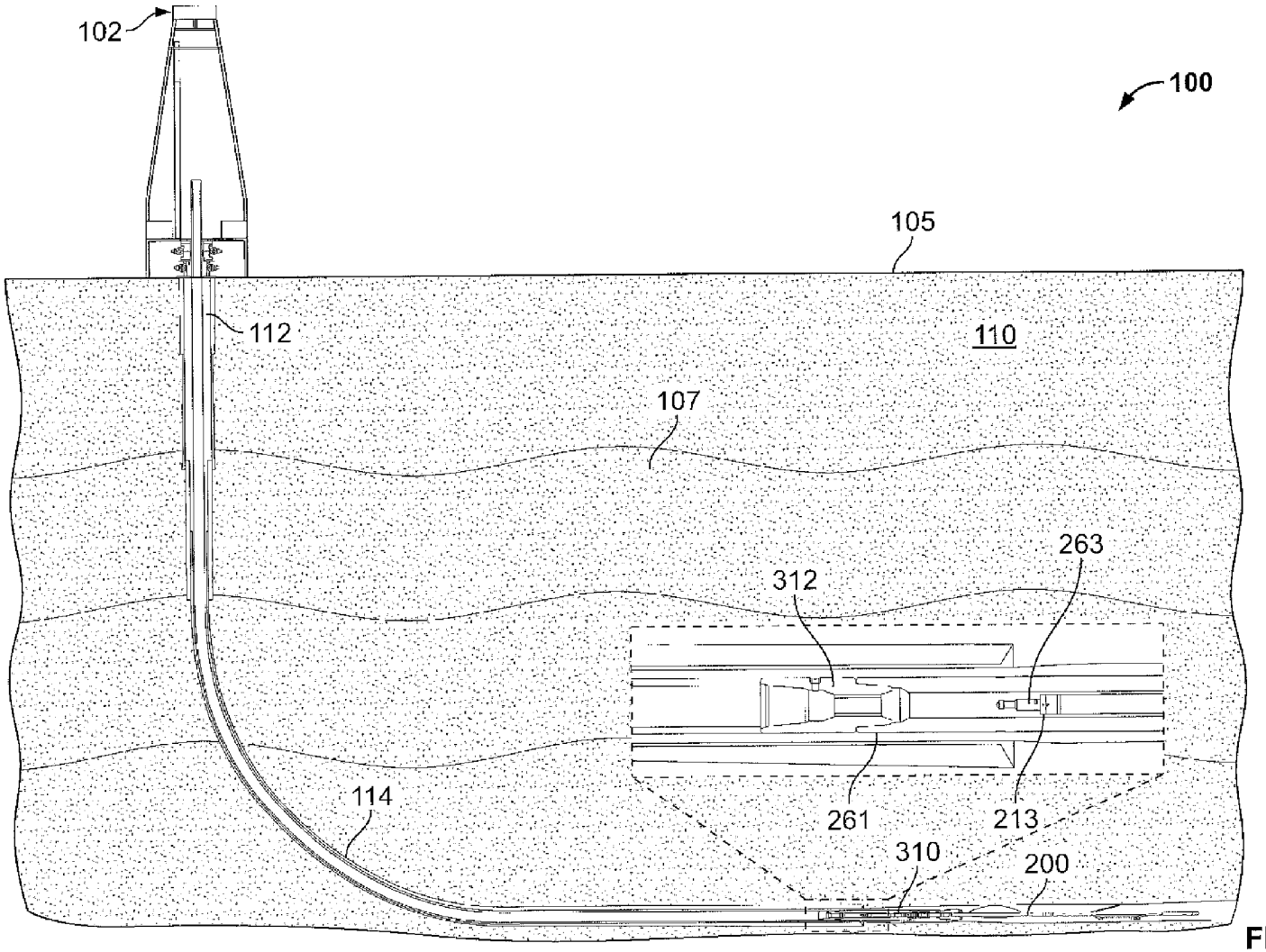

In FIG. 1E, the cable 111 and the running tool assembly 202 have been completely retrieved and removed from drill string 114. The system 100 is ready for data logging. As previously noted, in some implementations, the tool string 200 may not include a running tool 202, a crossover tool 211, or a cable 111. For example, the tool string 200 may be directly pumped down the drill pipe without being lowered on a cable 111. As discussed above, the logging tool assembly 220 is disposed below the lower end of the bottom hole assembly 300 and can obtain data from the geologic formations as the logging tool assembly 220 moves past the formations. The drill pipe string 114 is pulled upward in the wellbore 150 and as the logging tool assembly 220 moves past the geologic formations, data is recorded in a memory logging device that is part of the logging tool assembly 220 (shown in FIGS. 2A to 2E). The drill string is pulled upward by the rig equipment at rates conducive to the collection of quality log data. This pulling of the drill string from the well continues until the data is gathered for each successive geologic formation of interest. After data has been gathered from the uppermost geologic formations of interest, the data gathering process is completed. The remaining drill pipe and bottom hole assembly containing the logging tool string 200 is pulled from the well to the surface 105. In some implementations, the logging tool string 200 can be removed from the well to the surface 105 by lowering on a cable 111 a fishing tool adapted to grasp the fishing neck 263 while the tool string and drill pipe are still in the well bore. The tool grasps the fishing neck and then the cable is spooled in and the tool and the logging tool string are retrieved. The data contained in the memory module of the logging tool assembly 220 is downloaded and processed in a computer system at the surface 105. In some implementations, the computer system can be part of the data logging control truck 115. In some implementations, the computer system can be off-site and the data can be transmitted remotely to the off-site computer system for processing. Different implementations are possible. Details of the tool string 200 and the bottom hole assembly 300 are described below.

Figures 2A, 2B, 2C, 2D:
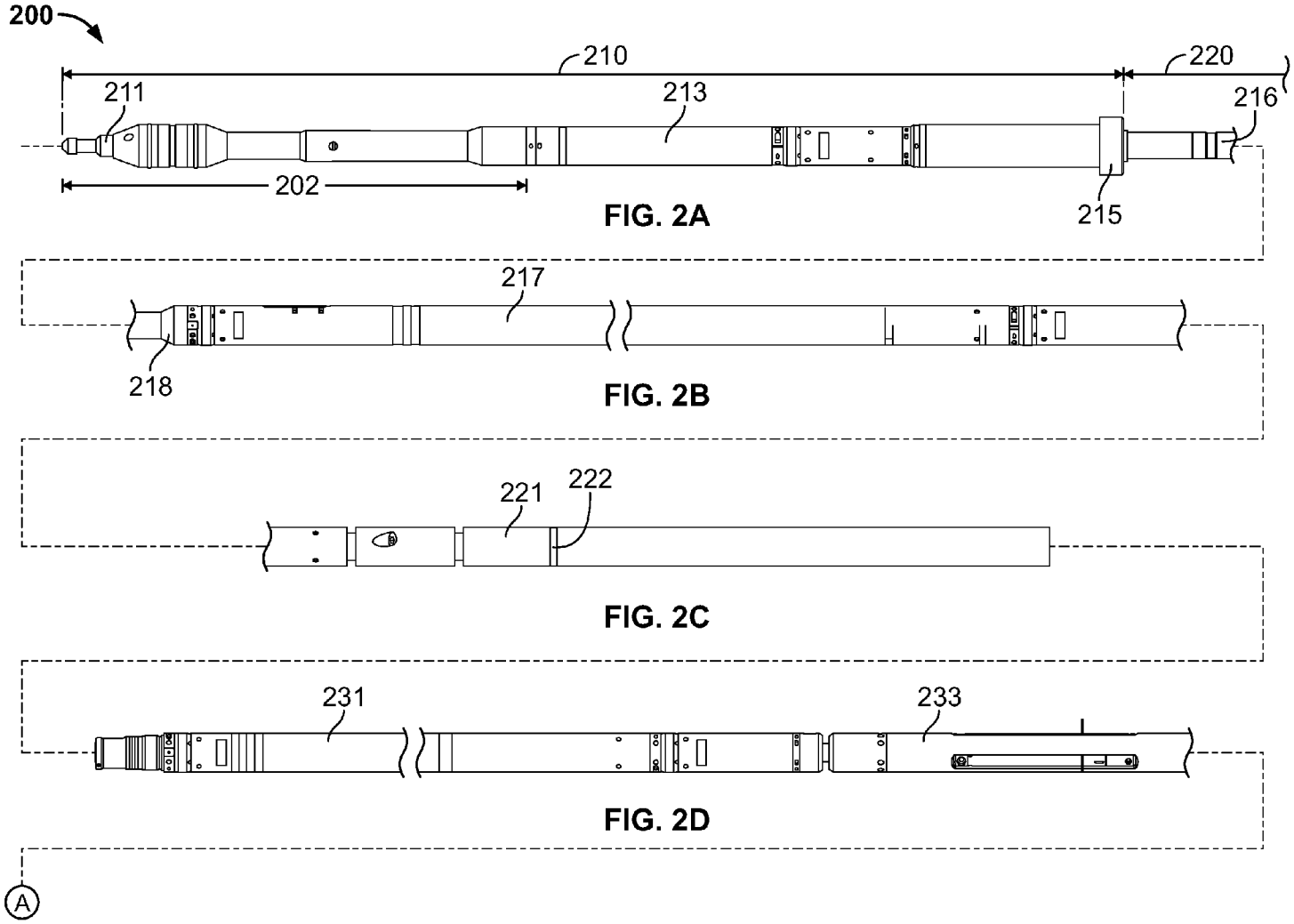
FIGS. 2A to 2K are side views of a logging tool string applicable to the operations illustrated in FIGS. 1A to 1E.

FIGS. 2A to 2K are side views of the logging tool string 200 applicable to the operations illustrated in FIGS. 1A to 1E. The logging tool string 200 includes two major sections: the landing assembly 210, and the logging tool assembly 220 that can be separated at a landing shoulder 215. Referring to FIGS. 2A and 2B, the complete section of the landing assembly 210 and a portion of the logging tool assembly 220 are shown. The landing assembly 210 can include the crossover tool 211, a nozzle 245, a spring release assembly 261, a motorized tool assembly 213, and the landing shoulder 215 followed by a latching section 216 connecting with a battery subsection 217. The landing assembly 210 allows the logging tool string 200 to engage with the bottom hole assembly 300 (e.g., within the landing sub 310) without damage to onboard instruments. The landing shoulder 215 can engage with latching jaws of the landing sub 310; and the latching section 216 has a diameter smaller/narrower than the overall diameter of the logging tool string 200 to receive the latching jaws. The narrowed latching section is followed by a tapered surface 218 to transition to the battery subsection 217. The tapered surface 218 allows the logging tool string 200 to be retrieved from the landing sub.

A running tool 202 comprises a subset of the landing assembly 210. The running tool 202 includes the crossover tool 211 and the spring release assembly 261. Retrieval of the running tool 202 will be described later herein. The logging tool assembly 220 includes various data logging instruments used for data acquisition; for example, the battery subsection 217, a sensor and inverter section 221, a telemetry gamma ray tool 231, a density neutron logging tool 241, a borehole sonic array logging tool 243, a compensated true resistivity tool array 251, among others. An accelerometer 222 is located in inverter section 221. In some embodiments, the accelerometer 222 is a MEMS Technology, micro-electro-mechanical-system. This electro-mechanical device is located onto a silicon chip and is part of the sensor printed circuit board located in the inverter section 221. This sensor measures movement or acceleration in the Z axis. The Z axis is in line with the up and down motion of the logging tool string, e.g., running in and out of the well.

Referring to the landing assembly 210, the running tool 202 is securely connected with the cable 111 by the crossover tool 211. As the tool string 200 is propelled down the bore of the drill string by the fluid pressure, the rate at which the cable 111 is spooled out maintains movement control of the tool string 200 at a desired speed. After landing of the tool string 200, the running tool can be released by the motorized tool assembly 213. The motorized tool releasable subsection 213 includes an electric motor and a release mechanism including dogs 249 for releasing the running tool section 202 from the fishing neck disposed on the upper portion of the logging tool assembly 220. The electric motor can be activated by a signal from the diagnostic module in the logging assembly after the diagnostic module has confirmed that the logging assembly is operating properly. The electric motor can actuate the dogs 249 to separate the running tool 202 from the rest of the landing assembly 210.

Referring to the logging tool assembly 220 in FIG. 2A. The logging tool assembly 220 and the landing assembly 210 are separated at the landing shoulder 215. The landing shoulder 215 can engage with the landing sub 310 to receive stopping force during landing. One major functional section behind the landing shoulder 215 is the battery subsection 217, connected by the latching section 216 of a smaller diameter than that of the battery subsection 217. The diameter of the battery subsection 217 is generally similar to the overall diameter of the logging tool string 200. The smaller diameter of the latching section 216 can engage with components of the landing sub 310 to reduce landing velocity using friction. Details of the landing phase involving the latching section 216 are described in FIGS. 5A to 5E. The battery subsection 217 can include high capacity batteries for logging tool assembly 220's extended use. For example, in some implementations, the battery subsection 217 can include an array of batteries such as Lithium ion, lead acid batteries, nickel-cadmium batteries, zinc-carbon batteries, zinc chloride batteries, NiMH batteries, or other suitable batteries. Following the battery subsection 217 is the sensor and inverter section 221 in FIG. 2C. The sensor and inverter section 221 can include sensors for detecting variables used for control and monitoring purposes (e.g., accelerometers, thermal sensor, pressure transducer, proximity sensor), and an inverter for transforming power from the battery subsection 217 into proper voltage and current for data logging instruments.

Figures 2E, 2F, 2G:
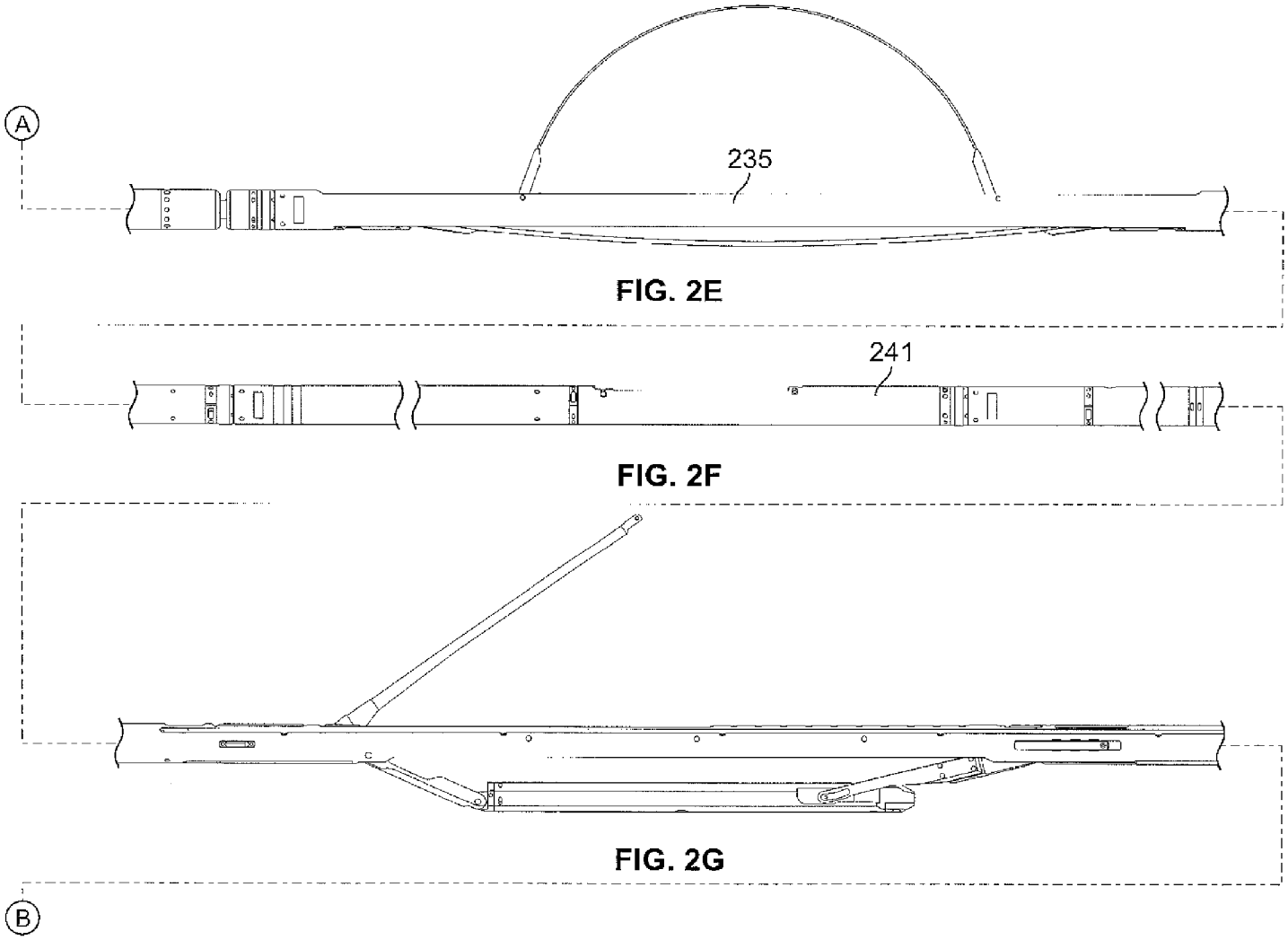

In FIGS. 2D and 2E, the logging tool assembly 220 further includes the telemetry gamma ray tool 231, a knuckle joint 233 and a decentralizer assembly 235. The telemetry gamma ray tool 231 can record naturally occurring gamma rays in the formations adjacent to the wellbore. This nuclear measurement can indicate the radioactive content of the formations. The knuckle joint 233 can allow angular deviation. Although the knuckle joint 233 is positioned as shown in FIG. 2D, it is possible that the knuckle joint 233 can be placed at a different location in the tool string, or a number of more knuckle joints can be placed at other locations of the tool string 200. In some implementations, a swivel joint (not shown) may be included below the landing assembly 210 to allow rotational movement of the tool string. The decentralizer assembly 235 can enable the tool string 200 to be pressed against the wellbore 150.

In FIGS. 2F to 2I, the logging tool assembly 220 further includes the density neutron logging tool 241 and the borehole sonic array logging tool 243.

Figures 2H, 2I, 2J, 2K:
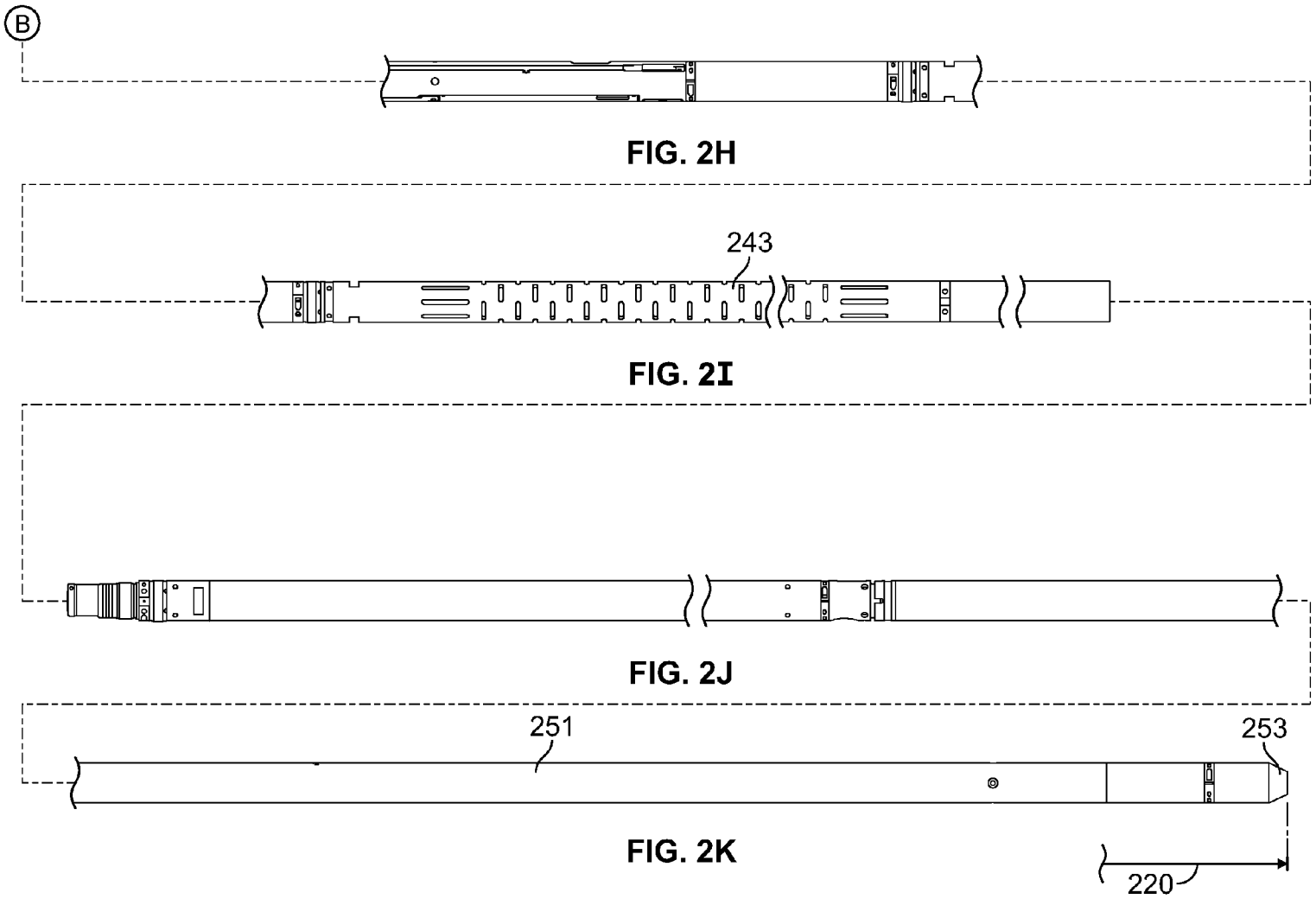

In FIGS. 2E and 2K, the logging tool assembly 220 further includes the compensated true resistivity tool array 251. At the end of the logging tool string 200 is a tapered distal end 253 for interacting with bias springs of the landing sub 310. In other possible configurations, the logging tool assembly 220 may include other data logging instruments besides those discussed in FIGS. 2A through 2K, or may include a subset of the presented instruments.

Figure 3A:
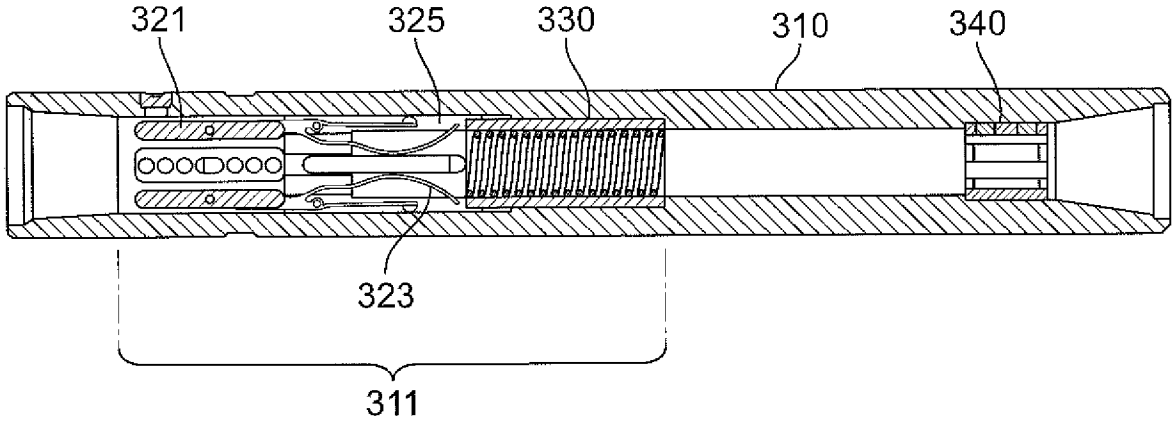
FIG. 3A is a cross-sectional side view of a landing sub using a logging tool latch mechanism applicable to the logging tool conveying system illustrated in FIGS. 1A to 1E.

FIG. 3A is a cross-sectional side view of the landing sub 310 having latch assembly 311 applicable to the logging tool conveying system 100 illustrated in FIGS. 1A to 1E disposed in the landing sub. The landing sub 310 includes a landing/latching assembly 311 to receive the landing shoulder 215 of the logging tool string 200 and a magnet array 340 to trigger a sensor (e.g., a reed switch) in the logging tool string 200 for signaling about the landing. The landing assembly 311 (also known as "insert") includes a latching assembly comprising a number of latching jaws 321, their corresponding biasing springs 323, an axial spring 330 for absorbing axial impact, and a latching jaw housing 325 for retaining and connecting the latching jaws 321 to the axial spring 330. In the embodiment illustrated in FIGS. 3A to 3D, the four latching jaws 321 are radially distributed inside the bore of the landing sub 310. It will be understood more or less latching jaws may be used in alternative implementations of the landing assembly 311. The latching jaws 321 can move towards the center when actuated and can rest on the bore of the landing sub 310 when the logging tool string 200 is not inserted. The latching jaws 321 are kept at the rest position by the biasing springs 323. The latching jaws 321 are retained in the latching jaw housing 325 that provides structural support and connection for the biasing springs 323. The latching jaw housing 325 connects the latching jaws 321 to the axial spring 330 to transfer compressional forces acting on the latching jaws 321 towards the axial spring 330 that acts as a shock absorber.

Figure 3B:
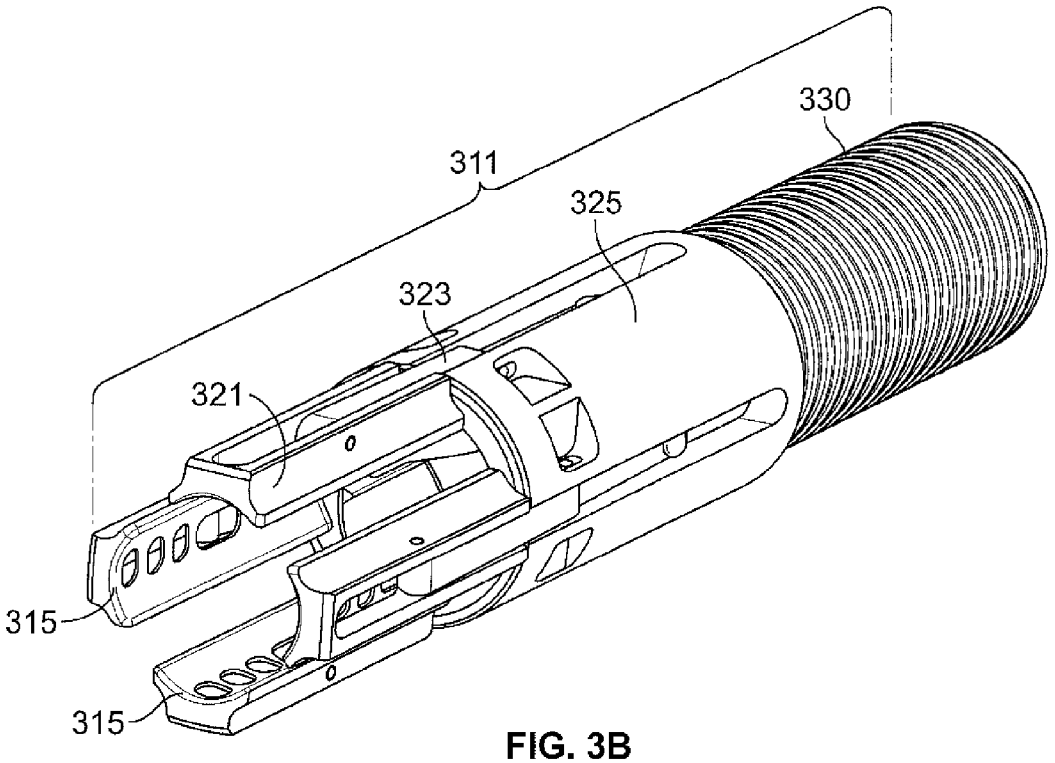
FIGS. 3B and 3C are perspective views of the logging tool latch mechanism at open and closed state respectively.
Figure 3C:
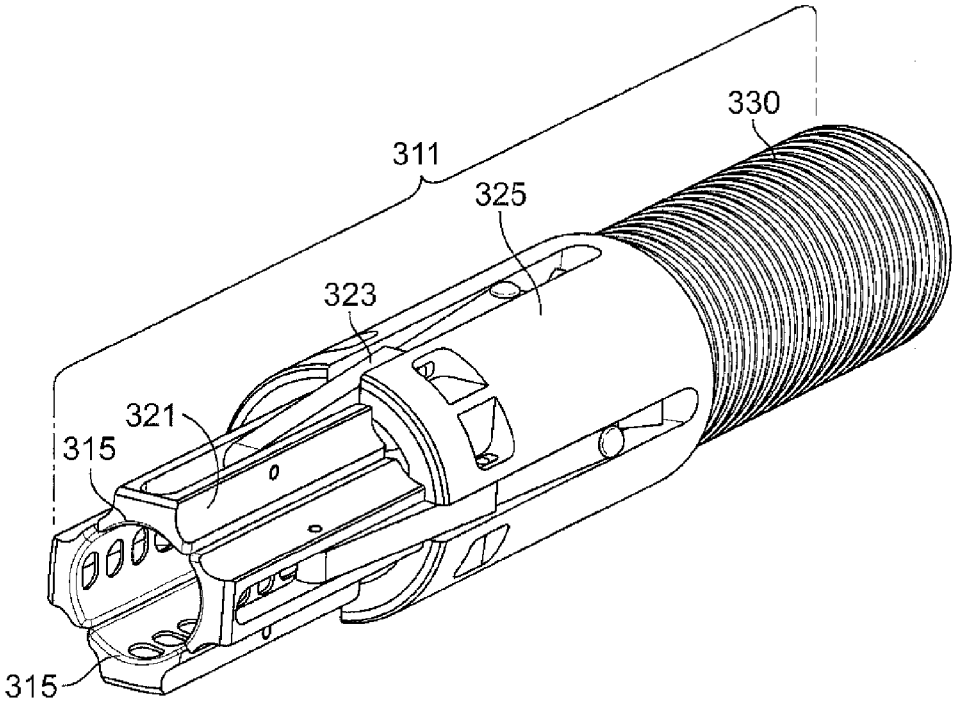

Enlarged perspective views of the logging tool latch mechanism 311 are presented in FIGS. 3B and 3C. FIGS. 3B and 3C are perspective views of the logging tool latch mechanism at open and closed state respectively. In FIG. 3B, the latching jaws 321 are at open position to receive an incoming logging tool. The biasing spring 323 keeps the latching jaws 321 at open position by having an opening spring pushing against the inner surface of the landing assembly 311. Although four pieces of the latching jaws 321 are illustrated to be radially and evenly distributed, different configurations are possible. For example, less or more pieces of the latching jaws 321 may be used (e.g., 2 pieces, 5 pieces, or other appropriate amount). The pieces of the latching jaws 321 may also be radially distributed in a customized manner to receive specific logging tools. In FIG. 3C, the biasing spring 323 is actuated by the logging tool, rotating around a pivot of the latching jaw housing 325, closing the latching jaws 321. The closed latching jaws 321 provide a landing surface (also known as "latch face") 315 to engage with the landing shoulder 215 of the logging tool. The landing impact of the logging tool can then be transferred from the latching jaws 321 to the latching jaw housing 325 and absorbed by the axial spring 330. A detailed illustration with the logging tool at landed position is shown in FIG. 3D.

Figure 3D:
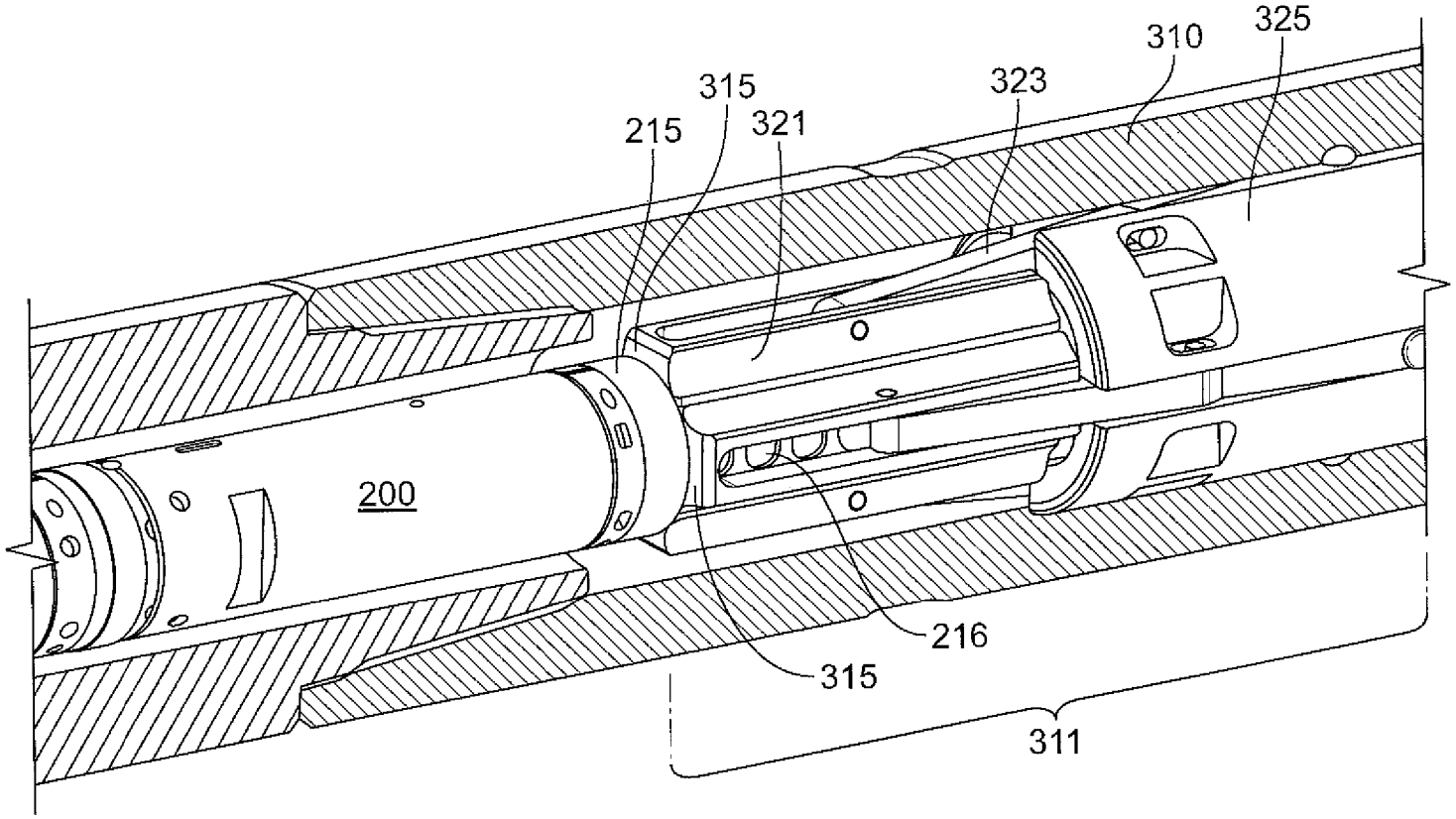
FIG. 3D is an enlarged cross-sectional perspective view of the logging tool latch mechanism engaging the logging tool.

FIG. 3D is an enlarged cross-sectional perspective view of the logging tool latch mechanism engaging the logging tool string 200 (i.e., at closed position at landing of the logging tool 200). The landing shoulder 215 of the logging tool string 200 is shown contacting latch face 315 of the latching jaws 321 (i.e., logging tool string 200 is landed in the landing sub 310). In some implementations, the landing shoulder 215 may further include energy absorbing or dampening mechanisms.

Figure 4:
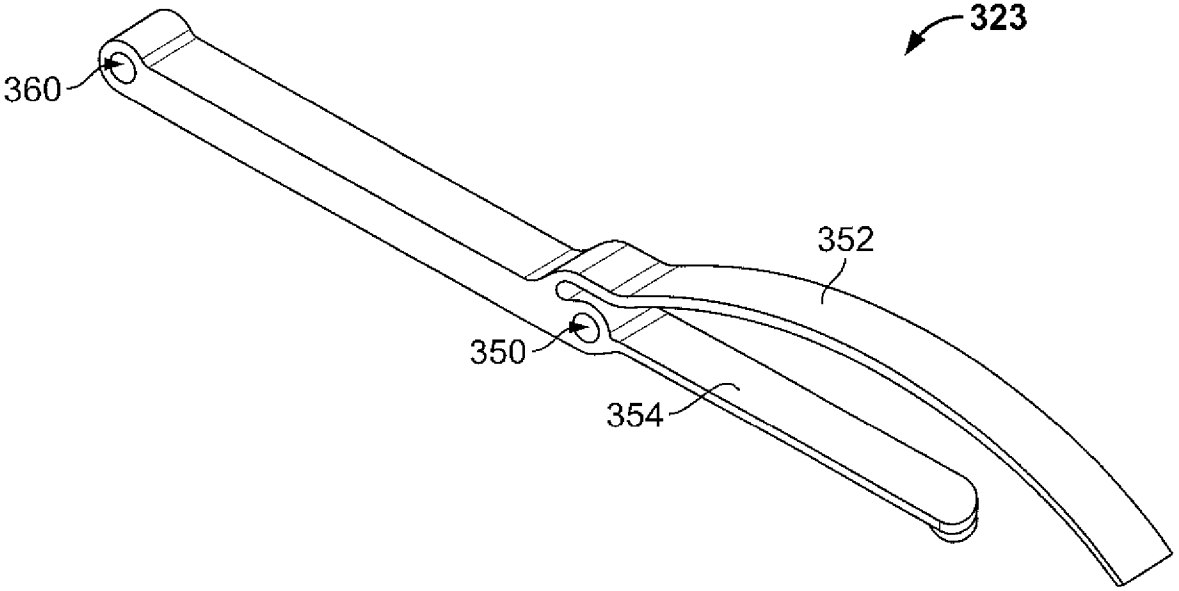
FIG. 4 is a perspective view of an instance of a biasing spring used in the landing sub in FIG. 3.

FIG. 4 is a perspective view of an instance of the biasing spring 323 used in the landing sub in FIG. 3. The biasing spring 323 includes an actuation pivot 350, a closing arm 352, an opening arm 354, and a latching jaw connection pivot 360. The biasing spring 323 can rotate around the actuation pivot 350 during actuation. For example, when the closing arm 352 is pressed downwards (e.g., towards the opening arm 354, when the logging tool string 200 enters the landing sub 310), the biasing spring 323 can rotate around the actuation pivot 350 and raise the latching jaw connection pivot 360 upwards. When the closing arm 352 is released (e.g., when the logging tool string 200 is removed and the closing arm 352 springs away from the opening arm 354), the biasing spring 323 rotates around the actuation pivot 350 and lowers the latching jaw connection pivot 360. The latching jaws 321 can rotate around the latching jaw connection pivot 360 to rest against the inner surface of the bore of the landing sub 310 during the absence of the logging tool string 200 as illustrated in FIG. 3, or the latching jaws 321 can rotate around the latching jaw connection pivot 360 to engage with the landing shoulder 215 when the logging tool string 200 enters the landing sub 310.

Figure 5A:
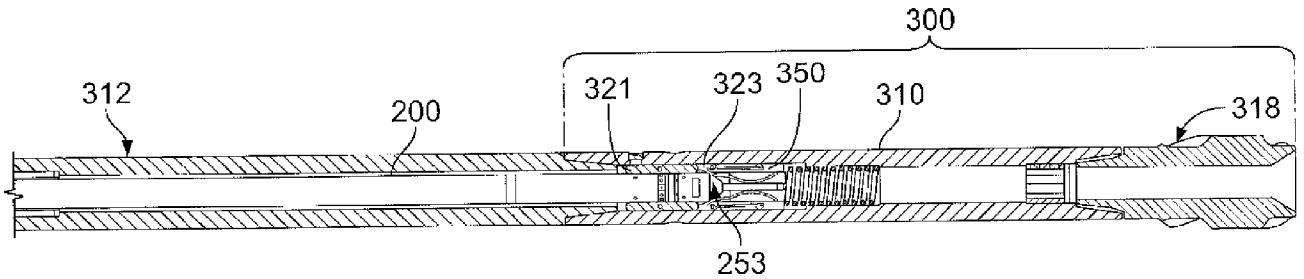
FIGS. 5A to 5E are cross-sectional side views of the logging tool string inside a bottom hole assembly during different operational phases.

FIGS. 5A to 5E are cross-sectional side views of the logging tool string 200 inside the bottom hole assembly 300 during different operational phases. Turning first to FIG. 5A, the logging tool string 200 is approaching from the nozzle sub 312 towards the deployment sub 318. Inside the landing sub, the distal end 253 is approaching the biasing springs 323. The distal end 253 is tapered to enter and force open the four closing arms 352 of the biasing springs 323 in the latching jaw housing 325. As the closing arms 352 are compressed down towards the latching jaw housing 325, each biasing spring 323 rotates around the corresponding actuation pivot 350 and raises the latching jaws 321 towards the logging tool string 200.

Figure 5B:
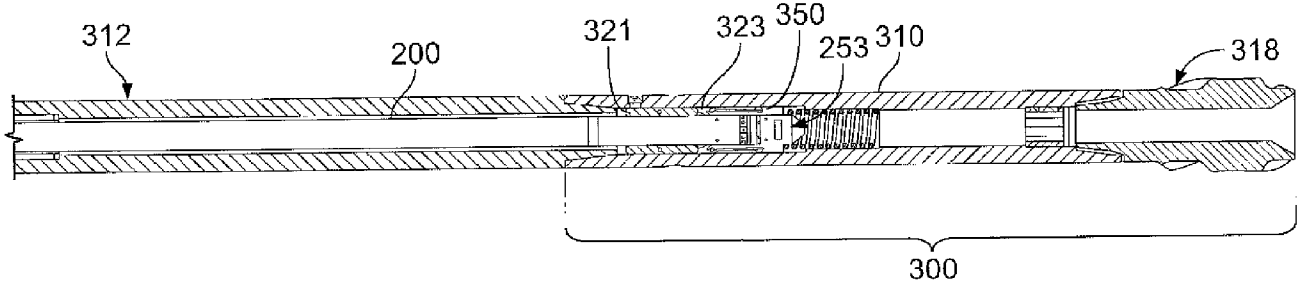

Turning now to FIG. 5B, the logging tool string 200 has fully entered and compressed down the closing arms 352. The latching jaws 321 are pressing against the logging tool string 200 as a result of the compression of the closing arms 352.

Figure 5C:
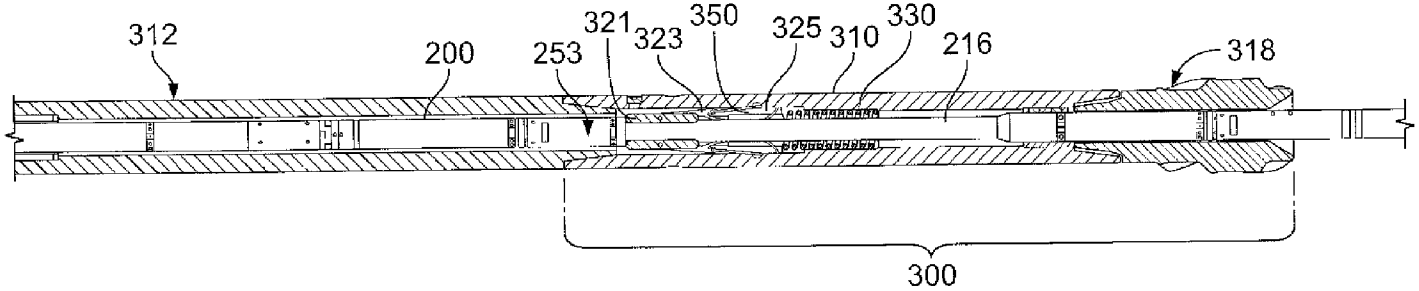

As the logging tool string 200 continues to be pushed forward, as illustrated in FIG. 5C, the latch section 216 becomes in contact with the closing arms 352. The latch section 216 has a smaller diameter than the rest of the logging tool string 200. This reduction in diameter allows the latching jaws 321 to move towards the logging tool string 200 in the radial direction. As the logging tool string 200 continues to move forward, the landing shoulder 215 engages with the latch face 315 of the latching jaws 321, compressing the axial spring 330 via the latching jaws 321 and the latching jaw housing 325. The axial spring 330 absorbs the impact and the friction between the logging tool string 200 and the closing arms 352 of the biasing spring 323 dampens the impact, resulting in a gentle landing to protect the logging tool string 200 from damage of impact or vibration. Additionally of note, the magnet array 340 is positioned in the landing sub 310 to indicate to a sensor of the logging tool string 200 for signaling the landing position of the logging tool string 200. It will be understood that various implementations of the sensor may be used. For example, the sensor may be a reed switch that forms a closed circuit under the influence of the magnet array 340 when the logging tool string 200 is at landing position. Other implementations are possible.

Figure 5D:
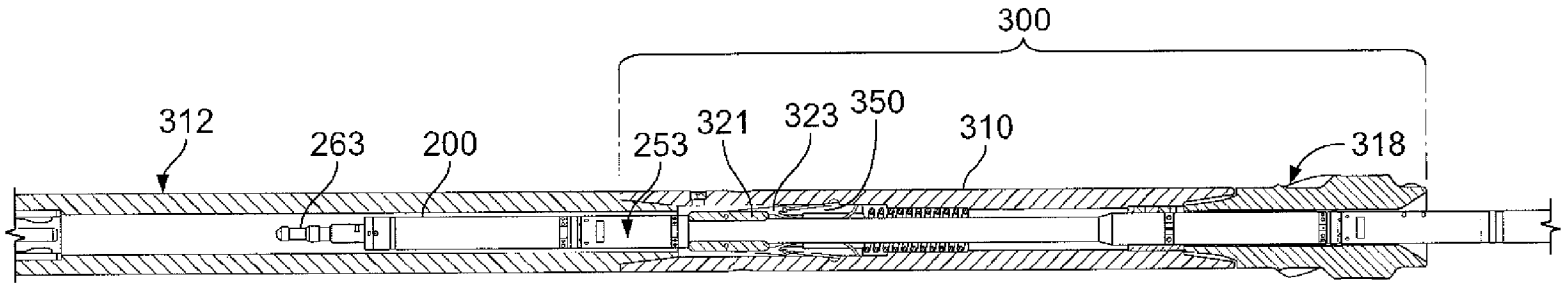

In FIG. 5D, after the logging tool string 200 has landed, the spring release assembly 261 releases at the fishing neck 263 to free the logging tool assembly 220 at the deployment sub 318. It will be understood that landing/latch assembly 311 may be used in logging systems wherein the tool string 200 is not "pumped down" (i.e., fluid is not pumped behind the tool string 200) such as in a vertical well or slightly deviated wells.

Figure 5E:
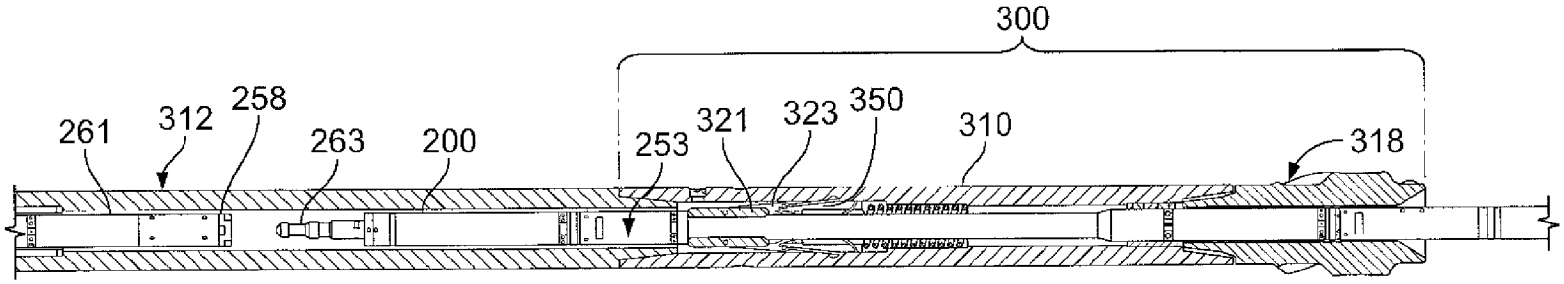

FIG. 5E illustrates the operation of retrieving the logging tool string 200 after deployment. The spring release assembly 261 can reengage with the fishing neck 263. The logging tool string 200 can then be retracted using a wireline/slickline. During the retracting phase, the tapered surface 218 on the logging tool string 200 can force open the latching jaws 321 and allow the rest of the logging tool string 200 to move through. As the distal end 253 has passed the closing arms 352 of the biasing springs 323, the opening arms 354 return the latching jaws 321 to the open position, resting against the inner bore of the landing sub 310.

Figure 5F:
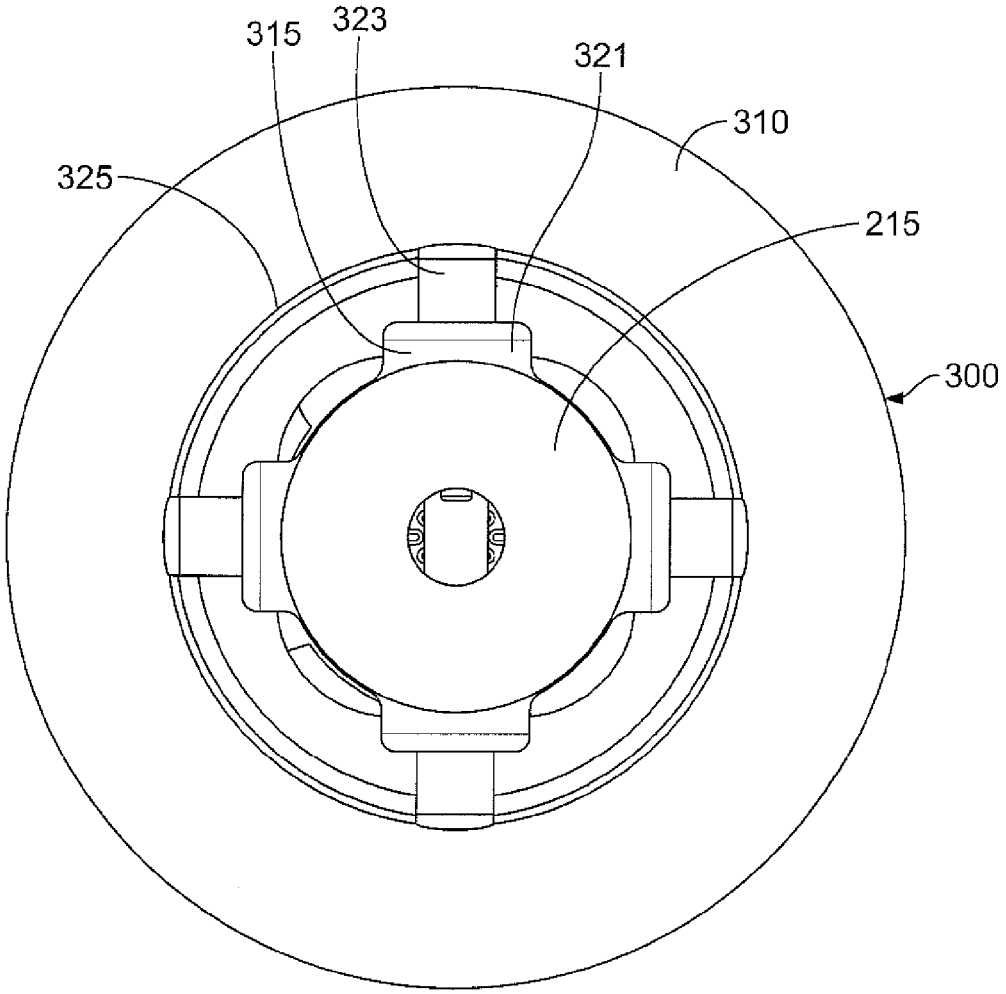
FIG. 5F is a front view of the logging tool string inside the bottom hole assembly at engagement as illustrated in FIG. 5C.

FIG. 5F is a front view of the logging tool string 200 inside the bottom hole assembly 300 at engagement as illustrated in FIG. 5C.

Figure 6A:
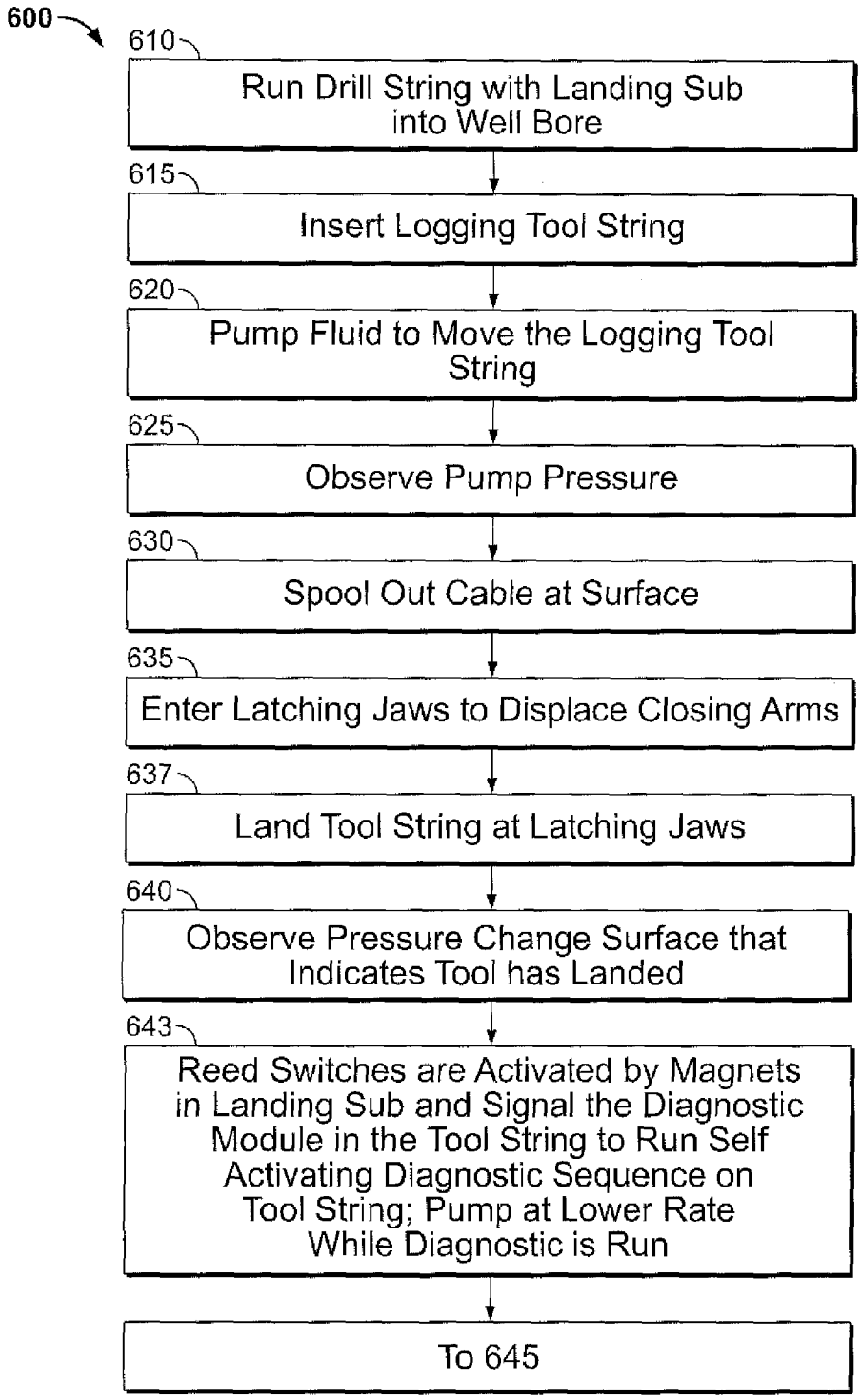
FIGS. 6A and 6B are a flow chart illustrating the operations of landing the logging tool in the bottom hole assembly.
Figure 6B:
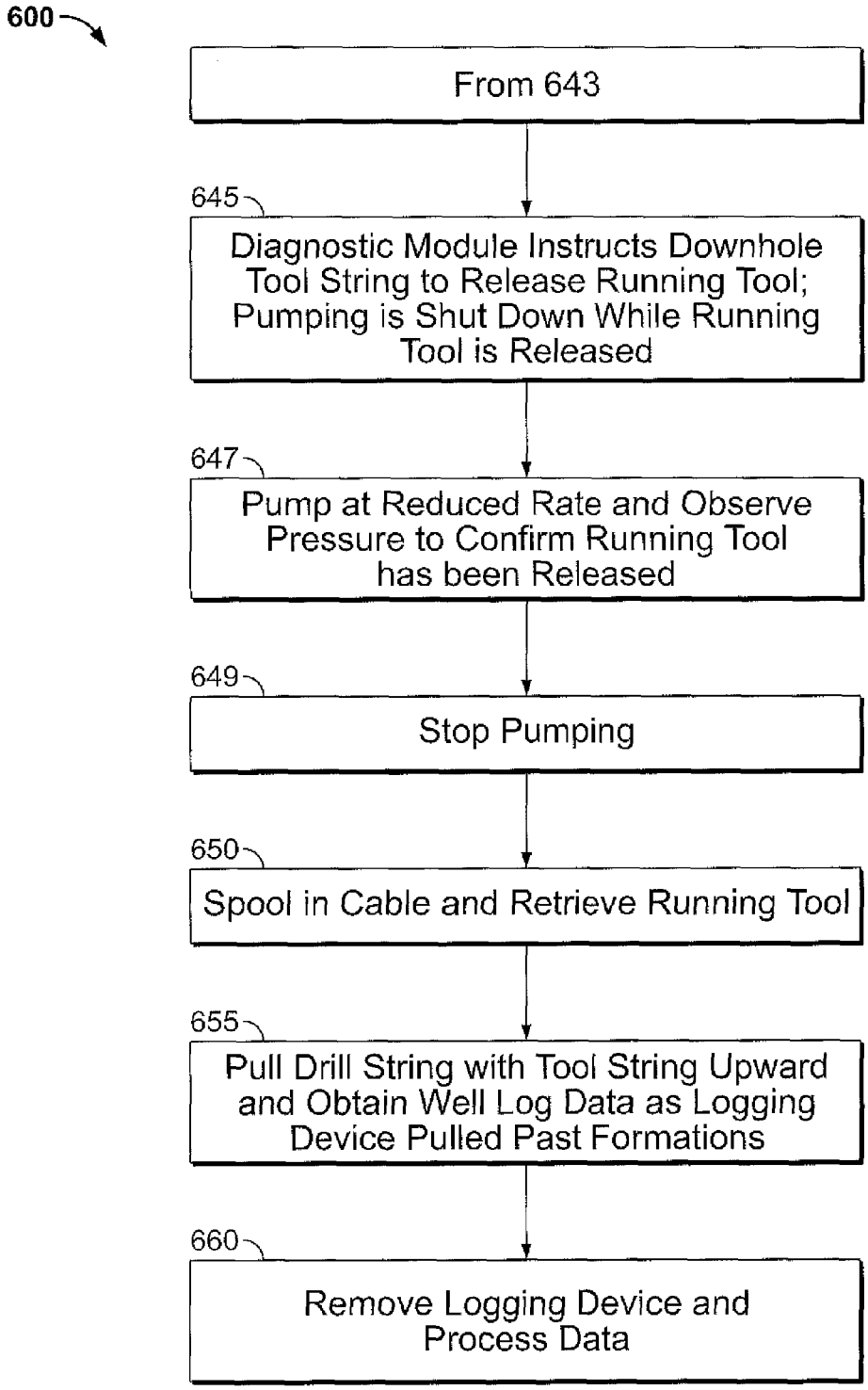

FIGS. 6A and 6B are flow chart 600 illustrating the operations of landing the logging tool string 200 in the bottom hole assembly 300. Referring to FIG. 6 and the prior figures, at 610, a drill pipe string is run into a wellbore to a predetermined position. The drill pipe has a longitudinal bore for conducting fluids, for example, drilling fluids, lubrication fluids, and others. The drill pipe string can include a landing sub with a longitudinal bore disposed proximal to the lower end of the drill pipe string. For example, the landing sub 310 can be part of a bottom hole assembly 300 installed at the lower end of the drill pipe string. In some implementations, the step 610 may be represented in FIG. 1A, where the wellbore 150 has a substantially deviated section and the drill pipe string 114 is run into the wellbore 150.

At 615, a logging tool string is inserted into the upper end of the bore of the drill pipe string. The logging tool string 200 may have a battery powered memory logging device. The logging tool string can be attached to a cable via a crossover tool. The cable may be used to lower the logging tool string into the wellbore at a desired velocity. In some implementations, the step 620 may be represented in FIG. 1B, where the logging tool string 200 is inserted into the pipe string 114 at the upper end near the surface 105. The logging tool string 200 can have a running tool 202 (as in FIGS. 1D and 2A) and can be attached to the cable 111 via the crossover tool 211.

Figure 7:
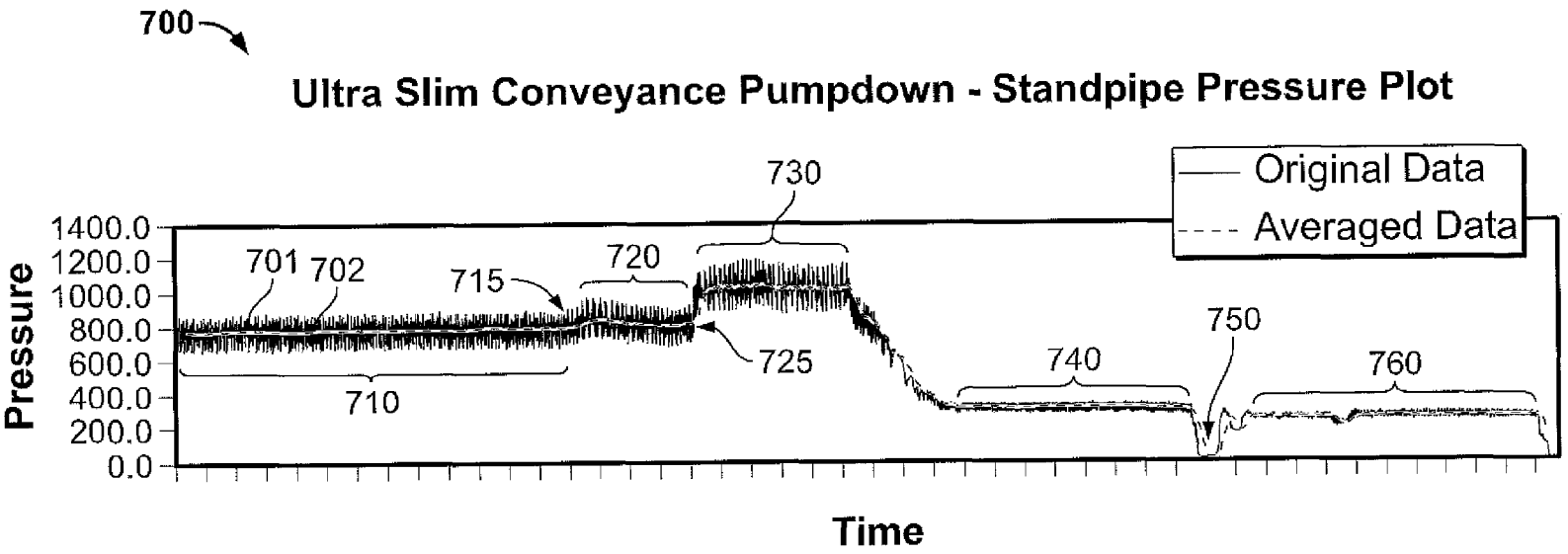
FIG. 7 is an example surface pressure profile for fluid used in the operation of the logging tool conveyance system of FIG. 1.

At 620, a fluid is pumped into the upper proximal end of the drill string bore above the logging tool string to assist movement of the tool string down the bore of the drill string. The fluid pressure can be applied onto the logging tool string to propel the downward movement of the tool string. The fluid pressure may also be monitored at the surface in real time to determine the status of the logging tool string at 625. For example, a pressure profile 700 is illustrated in FIG. 7, describing different stages of the movement of a logging tool string. Turning briefly to FIG. 7, the phase 710 represents a relatively constant pressure of the propelling fluid applied to the logging tool string at step 620. The propelling fluid pressure (with certain noise) is reflective of the speed that the tool is moving down the drill string bore and the rate at which fluid is being pumped through the drill string. The speed of movement is reflective of the speed at which the cable is spooled out at the surface as the fluid is pumped behind the logging tool string and the logging tool string is moving down the longitudinal bore of the drill pipe string at 630. As noted above in some implementations, the logging tool string is not "pumped down" the drill pipe string.

At 635, the tool string is initiating a landing phase in the landing sub of the drill pipe by entering the landing latch assembly to displace closing arms of biasing springs, to actuate latching jaws to close towards the logging tool string. The biasing springs include closing arms that can actuate the latching jaws to close and opening arms that can return the latching jaws to open positions. The closing arms can be a convex shape forcing a frictional contact with the latch section of the logging tool string (e.g., as illustrated in FIGS. 5A and 5B). A latch section of the logging tool string 200 has a diameter smaller than the overall diameter of the logging tool string 200 and the latching jaws can clamp onto the latch section of logging tool strings. A shoulder 215 of the latch section of the logging tool string 200 can contact latch face 315 and land directly onto the latching jaws 321 which are clamping against the latch section of the logging tool string 200. At 637, the logging tool string is landed using the latching jaw stopping the shoulder by pressing against an axial spring to absorb the landing impact energy.

The landing operation is further dampened by the closing arms of the biasing springs in contact with the latching section of the logging tool string.

During the landing phase, at least a portion of the logging tool string 200 that has logging tools (e.g., data logging instrument and equipment) is disposed below the bottom hole assembly 300 located on the distal end of the drill pipe string. For example, the landing procedure may be monitored in the change of the surface fluid pressure at 640, as illustrated in FIG. 7. Turning briefly to FIG. 7, an increase in pump pressure at 715 indicates that the tool string has entered the landing sub and the annular area between the outside of the logging tool string and the landing sub has been reduced resulting in a higher fluid pressure. For example, as illustrated in FIGS. 5A and 5B, the logging tool string 200 has entered the landing sub 310 but has not yet landed. In FIG. 7, the pressure profile at section 720 is reflective of the tool body and its varying outside diameter passing through the varying inside diameter of the landing sub. The increase of pressure at 715 can be caused by a temporary reduction in cross section for fluid flow when the logging tool string enters the landing sub. But the fluid flow is not interrupted substantially as the tool string continues to move downwards.

At 725, however, a substantial increase of fluid pressure indicates that the logging tool string has landed onto the landing sub. This pressure increase can be due to the closing of available flow paths due to logging tool landing. For example, in FIGS. 1E and 5C, the nozzle 245 is inserted into the nozzle sub 312 and the landing shoulder 215 is pressed against the latch face 315 of the landing latching assembly 311. However, fluid can continue to flow, though at a higher resistance, through a conduit in the nozzle 245 and the fluid by-pass, at an increased pressure. The increased pressure can be observed at 730 as the fluid is circulated through the by-pass. This observation at the surface of an increase in pressure at step 640 indicates to the operator that the downhole tool string has landed.

While the diagnostic is being run downhole, the operator pumps fluid at a lower rate. At step 643 the reed switches are activated when the switches are positioned opposite the magnets in the landing sub. The closing of the reed switch is sensed by the diagnostic module in the tool string and can be interpreted as a signal to run a self-diagnostic to determine if the logging tools are functioning properly.

At step 645, based on the confirmation by the diagnostic sequence run in the tool string that the tool string is operating properly, instructions are sent by the diagnostic module of the downhole tool to release the running tool from the tool string and displace the running tool 202 away from the upper end of the tool string. For example, as illustrated in FIG. 3C, the running tool is released as the spring release assembly 261 disengages with the fishing neck 263. The releasing procedure is also illustrated in FIG. 1D. The operator shuts down pumping while the running tool is being released.

At step 647, pumping is resumed at the rate established in step 643 and the surface pressure is observed to confirm that the running tool has been released. At step 649, pumping is stopped and sustained for a period of time for the crossover tool to be retrieved. This is illustrated in FIG. 7, where at 750 the fluid pressure drops and sustains at zero. For example, in FIG. 7, fluid pressure of section 760 is observed at surface while pumping through the tool string at 3 bbl/min. The pressure observed in section 760 is lower than the previously observed pressure in section 740, indicating the running tool 202 has been displaced from the landing nozzle and the logging tool string is properly seated in the landing sub and ready to obtain log data.

At 649, pumping is stopped and after the fluid pressure has been decreased to zero, at step 650, the cable is spooled in at the surface and the running tool is retrieved.

At 655, the drill pipe string is pulled upward in the wellbore, while log data is being recorded in the memory logging device as the data is obtained by the tool string passing by the geologic formations. For example, the data logging can include recording the radioactivity of the formation using a telemetry gamma ray tool, measuring formation density using a density neutron logging tool, detecting porosity using a borehole sonic array logging tool, recording resistivity using a compensated true resistivity tool array, and other information. After gathering and storing the log data as the logging device travels to the surface and the drill string is removed from the wellbore, the tool string is removed from the landing sub, the memory logging device is removed. The data in the memory device is then obtained and processed in a computer system at the surface. The data may be processed in the logging truck 115 at the well site or processed at locations remote from the well site.

FIG. 7 is the example pressure profile 700 for conveying logging tools, corresponding to the flow chart 600 illustrated in FIG. 6. The pressure profile 700 shows two data plots of fluid pressure (the y axis) versus time (the x axis). The first data set illustrated by trace 701 represents measured data at a high sampling rate. And the second data set illustrated by trace 702 represents averaged data points using every 20 measured data points. Therefore, the second data set provides a smoothed and averaged presentation of the surface pumping pressure.

A number of implementations have been described. Nevertheless, it will be understood that various modifications may be made. Further, the method 600 may include fewer steps than those illustrated or more steps than those illustrated. In addition, the illustrated steps of the method 600 may be performed in the respective orders illustrated or in different orders than that illustrated. As a specific example, one or more of the steps of method 600 may be performed simultaneously (e.g., substantially or otherwise). Other variations in the order of steps are also possible. Accordingly, other implementations are within the scope of the following claims.

What is claimed is:

1. A wellbore logging assembly comprising:

a logging tool string including a logging assembly having at least one logging tool operable to obtain and store data regarding at least one geologic formation penetrated by the wellbore;

a landing sub having a longitudinal bore therethrough, said longitudinal bore having an interior sidewall, said landing sub having a latching mechanism disposed in the longitudinal bore, said latching mechanism including at least one latch jaw coupled to a biasing spring, said biasing spring pivotably mounted about an actuation point therein to a latching jaw housing, said latch jaw movable radially inward away from the interior sidewall of the landing sub, said latch jaw having a latch face configured to engage a landing shoulder of the logging tool string, and wherein the at least one biasing spring includes a closing arm and an opening arm.

2. The assembly of claim 1, wherein the logging tool string further comprises: a latch section positioned below the latch face, said latch section having a diameter smaller than an outside diameter of the landing shoulder and a tapered surface adapted to allow for the latch section to exit the closing arm of the biasing spring.

3. The assembly of claim 1, wherein the landing sub further comprises an axial spring supporting the latch jaw within the latching jaw housing.

4. The assembly of claim 1, wherein the logging assembly further includes:

a diagnostic module operable to run a diagnostic sequence to determine if the at least one logging tool is functioning properly and send a signal to a release assembly on a running tool.

5. The assembly of claim 1, wherein the logging assembly further includes:

a sensing device operable to detect when the logging assembly is landed in the landing sub and send a signal to a diagnostic module.

6. The assembly of claim 5, wherein the signal sent by the sensing device further includes notifying the diagnostic module that the logging assembly is in proper position for logging and that the diagnostic module may begin a diagnostic sequence on the at least one logging tool.

7. The assembly of claim 1 further including:

a landing sleeve disposed in the bore of the landing sub wherein at least one magnet is disposed in the landing sleeve; and wherein the sensing device disposed in the tool string comprises a switch configured to close in response to the switch in the tool string being proximal to the magnet in the landing sleeve.

8. The assembly of claim 7 wherein the switch comprises a reed switch.

9. The assembly of claim 1, further including: a deployment sub disposed on a lower end of the assembly, said deployment sub having a longitudinal bore therethrough with a diameter larger than a diameter of the logging tool thereby allowing the logging tool to pass through the longitudinal bore.

10. The assembly of claim 9, wherein the logging tool is configured to extend below a lower end of the deployment sub when the logging tool assembly is landed in the landing sub.

11. The assembly of claim 1, wherein the logging assembly further includes a memory module to store data obtained by the at least one logging tool.

12. The assembly of claim 11 further including a battery disposed in the tool string adapted to supply power to the memory module.

13. The assembly of claim 1, wherein the biasing spring includes a latching jaw connection pivot point wherein the biasing spring can pivot about the actuation point during actuation and raise the latching jaw connection pivot point upwards.

14. A logging system for obtaining well log data from a wellbore comprising:

a drill string disposed in the wellbore, said drill string having a longitudinal bore therethrough; and a bottom hole assembly having an attachment structure for securing the bottom hole assembly to a lower end of the drill string, said bottom hole assembly including a landing sub having a longitudinal bore therethrough with a latch mechanism in said longitudinal bore, said latch mechanism comprising at least one latch jaw and at least one biasing spring having a closing arm and an opening arm, said biasing spring pivotably mounted about an actuation point therein to a latching jaw housing, said latch jaw movable radially with respect to a latch section of a tool string, said tool string comprising, a landing assembly including a release assembly and the latch section and a logging assembly including at least one logging tool operable to obtain data regarding at least one geologic formation penetrated by the wellbore.

15. The logging system of claim 14, wherein the logging assembly further includes:

a memory module operable to store the data obtained by the at least one logging tool;

a diagnostic module operable to run a diagnostic sequence to determine if the at least one logging tool is functioning properly and send a signal to the release assembly; and a sensing device operable to detect when the logging assembly is landed in the landing sub and send a signal to the diagnostic module.

16. The system of claim 15, wherein the signal sent by the sensing device further includes notifying the diagnostic module that the logging assembly is properly positioned for logging and that the diagnostic module may begin the diagnostic sequence on the at least one logging tool.

17. The logging system of claim 14, wherein the bottom hole assembly further comprises a nozzle sub having a bore therethrough; and wherein the landing assembly further comprises a running tool, the running tool including a nozzle member.

18. The logging system of claim 14, further including a surface pump system configured to pump fluid down the tool string behind the logging tool and observe fluid pressure at a surface location.

19. The system of claim 14, wherein the biasing spring includes a latching jaw connection pivot point wherein the biasing spring can pivot about the actuation point during actuation and raise the latching jaw connection pivot point upwards to move the latch jaw radially inward toward with respect to the latch section of the tool string.

20. The system of claim 19, wherein the latch mechanism further comprises an axial spring supporting the latch jaw within a latch jaw housing, the latch jaw having an outer profile configured to receive a landing shoulder of the latch section of the tool string.

21. The system of claim 14, wherein the bottom hole assembly further includes a deployment sub disposed on a distal end of the bottom hole assembly, said deployment sub having a longitudinal bore therethrough, said deployment sub configured to support the logging tool when the logging assembly is landing in the landing sub and the logging tool extends through the bore.

22. The system of claim 14, wherein the bottom hole assembly has a reamer disposed on the lower end of the bottom hole assembly, said reamer including a bore sized for passage of the logging tool therethrough.

23. The system of claim 14, wherein the logging tool is configured to extend below a lower end of the bottom hole assembly when the logging assembly is landed in the landing sub.

24. The system of claim 14, wherein the logging assembly further includes a memory module operable to store data obtained by the at least one logging tool.

25. The system of claim 24 further including a battery disposed in the tool string operable to supply power to the memory module.

26. A method of obtaining well log data from a wellbore comprising:

(a) running a drill pipe string having a longitudinal bore into the wellbore to a predetermined position, said drill pipe string including a landing sub disposed at or proximal to a lower end of the drill pipe string;

(b) inserting a logging tool string into a proximal upper end of the bore of the drill pipe string, said logging tool string comprising a landing assembly and one or more logging tools;

(c) landing the landing assembly of the logging tool string in the landing sub of the drill pipe string, wherein at least a portion of the logging tool string including the one or more logging tools is disposed below a lower end of the drill pipe string, said landing comprising:

i. actuating a latch jaw to close against a latch section of the logging tool string, the latch jaw coupled to a biasing spring, the biasing spring pivotably mounted about an actuation point therein to a latching jaw housing, and further the latch section having a diameter smaller than the diameter of the logging tool string;

ii. engaging the latch jaw with a shoulder of the logging tool string; and iii. arresting the logging tool string from moving relative to the landing sub.

27. The method of claim 26, wherein landing the logging tool string in the landing sub of the drill pipe string further comprises:

flattening a closing arm of the biasing spring by moving the logging tool string over the biasing spring, the closing arm connecting with a latch jaw movable in a radial direction with respect to the logging tool string.

28. The method of claim 26, further comprising:

pumping a fluid into an upper proximal end of the drill pipe string bore above the logging tool string to assist, via fluid pressure on the logging tool string, movement of the logging tool string down the bore of the drill pipe string;

observing a pump pressure at a surface location during the fluid pumping process;

observing a pump pressure at the surface location increasing when the logging tool string is landed in the landing sub; and determining by one or more devices in the logging tool string that the logging tool string is landed in the landing sub and sending one or more signals to one or more logging tools.

29. The method of claim 26, further including pulling the drill pipe string upward in the wellbore and recording data obtained by the one or more logging tools as the one or more logging tools is pulled upward by drill pipe string.

30. The method of claim 26, further including removing a memory logging device from the logging tool string and processing the recorded data in a computer system at a surface position.

31. The method of claim 30, wherein removing the memory logging device from the drill pipe string includes lowering on a cable a fishing tool having a grasping structure for releasably grasping a fishing neck on an upper end of the logging tool string disposed in the landing sub in the drill pipe string, while the tool string and the drill pipe string remain in the wellbore.

32. The method of claim 31, wherein removing the memory logging device from the drill pipe string includes removing the drill pipe string from the wellbore and removing the logging tool string from the landing sub when the drill pipe is removed from the wellbore.

33. The method of claim 26, further including:

activating a switch disposed in the logging tool string by positioning the switch in proximity to one or more magnets disposed in the landing sub of the drill pipe string and sending a signal to one or more logging tools that the logging tool string is in a landed position.

34. The method of claim 33 wherein the activated switch sends a signal to the logging tool string to run the self-diagnostic of the one or more logging tools to determine if they are functioning.

35. The method of claim 33, wherein activating a switch comprises closing a reed switch.

* * * * *